US005636929A

United States Patent [19]

Asano et al.

[11] Patent Number: 5,636,929

[45] Date of Patent: Jun. 10, 1997

[54] SHEET FEEDING APPARATUS HAVING MULTIPLE ROTARY MEMBERS AND CLEANING MEMBERS

[75] Inventors: Junichi Asano, Kawasaki; Kenichiro Hashimoto; Soichi Hiramatsu, both of Yokohama; Hiroyuki Inoue, Chiba; Takashi Nojima, Tokyo; Shinya Matsui; Tetsuo Suzuki, both of Yokohama, all of Japan

[73] Assignee: Canon Kabushiki Kaisha, Tokyo, Japan

[21] Appl. No.: 154,565

[22] Filed: Nov. 19, 1993

Related U.S. Application Data

[62] Division of Ser. No. 603,946, Oct. 26, 1990, Pat. No. 5,291,224.

[30] Foreign Application Priority Data

| | | | |
|---|---|---|---|
| Oct. 27, 1989 | [JP] | Japan | 1-281181 |
| Dec. 25, 1989 | [JP] | Japan | 1-336144 |
| Dec. 25, 1989 | [JP] | Japan | 1-336145 |
| Dec. 25, 1989 | [JP] | Japan | 1-336146 |
| Dec. 25, 1989 | [JP] | Japan | 1-336147 |
| Dec. 25, 1989 | [JP] | Japan | 1-336148 |

[51] Int. Cl.[6] ..... B41J 13/03

[52] U.S. Cl. ..... 400/641; 400/636; 400/701; 347/104

[58] Field of Search ..... 400/641, 701, 400/636, 636.2, 637, 637.1, 637.2, 637.3, 637.4, 637.5, 637.6, 639, 639.1, 639.2; 347/104; 271/272, 273; 198/494, 496, 497, 498, 499

[56] References Cited

U.S. PATENT DOCUMENTS

| | | | |
|---|---|---|---|
| 2,740,355 | 4/1956 | Wimpfheimer | 101/420 |
| 3,642,274 | 2/1972 | Herrington et al. | 271/79 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/140 R |
| 4,558,333 | 12/1985 | Sugitani et al. | 346/140 R |
| 4,565,360 | 1/1986 | Rünzi | 271/4 |
| 4,651,173 | 3/1987 | Ozawa et al. | 346/136 |
| 4,723,129 | 2/1988 | Endo et al. | 346/140 R |
| 4,740,796 | 4/1988 | Endo et al. | 346/140 R |
| 4,900,003 | 2/1990 | Hashimoto | 271/114 |
| 5,005,025 | 4/1991 | Miyakawa et al. | 346/25 |
| 5,018,886 | 5/1991 | Hiramatsu et al. | 400/545 |

FOREIGN PATENT DOCUMENTS

| | | |
|---|---|---|
| 3333371 | 3/1985 | Germany . |
| 3512068 | 10/1985 | Germany . |
| 3708601 | 10/1987 | Germany . |
| 59-123670 | 7/1984 | Japan . |
| 59-138461 | 8/1984 | Japan . |
| 59-188467 | 10/1984 | Japan . |
| 61-206676 | 9/1986 | Japan . |

OTHER PUBLICATIONS

Brandon, et al., "Starwheel Transport", *IBM Technical Disclosure Bulletin*, vol. 20, No. 5, p. 1693, Oct. 1977.

"Grit Drive Rollers", *Research Disclosure*, No. 298, Abstract No. 29856, Feb. 1989.

*Primary Examiner*—David A. Wiecking

*Attorney, Agent, or Firm*—Fitzpatrick, Cella, Harper & Scinto

[57] ABSTRACT

The present invention provides a recording system including a recording head for performing recording on a sheet, a first rotary member disposed at a downstream side of the recording head and contacting an unrecorded surface of the sheet on which the recording is performed by the recording head and adapted to apply a feeding force to the sheet, and a second rotary member being provided at its peripheral surface with a plurality of teeth and contacting a recorded surface of the sheet with the tips of the teeth thereof, and cooperating with the first rotary member to feed the sheet. The plural teeth of the second rotary member are staggered with other teeth in a direction transverse to a sheet feeding direction. A member is provided to clean the first and second rotary members.

24 Claims, 21 Drawing Sheets

SHEET FEEDING APPARATUS HAVING MULTIPLE ROTARY MEMBERS AND CLEANING MEMBERS

This application is a division of application Ser. No. 07/603,946, filed Oct. 26, 1990, now U.S. Pat. No. 5,291, 224, issued Mar. 1, 1994.

BACKGROUND OF THE INVENTION

1. Field of the Invention

The present invention relates to a sheet feeding apparatus applied to a recording system such as an ink jet recording system.

2. Description of the Related Art

In the past, a recording system which records an image on a recording medium (referred to as "recording paper" or to merely as "paper" hereinafter) such as a paper, OHP sheet or the like has been proposed to have a recording head of various recording types. The recording heads include a wire dot recording head, heat-sensitive recording head, heat transfer recording head, ink jet recording head and the like.

Among these recording heads, particularly, the ink jet recording head which directly ejects or discharges ink onto a recording paper is noticed in the point that a running cost thereof is inexpensive and a recording operation thereof is noiseless.

In such an ink jet recording system, as one of inherent constructions required due to the recording with the use of the ink, for example, a spur roller (refer to merely as "spur" hereinafter) constituting a sheet ejecting mechanism is used.

The spur is generally disposed, together with an ejector roller, at a downstream side of a recording head in a recording sheet feeding path and cooperates with the ejector roller to feed the recording sheet. That is to say, the recording sheet is pinched between the ejector roller and the spur to be moved. In such feeding of the recording sheet, the spur urges the recording sheet against the ejector roller, and the rotating ejector roller feeds the recording sheet by the use of a friction force created between the ejector roller and the recording sheet due to such urging force. In this case, the spur is arranged or disposed to contact a recorded surface (i.e., inked surface) of the recording sheet. Thus, the spur is constituted by a thin plate-shaped toothed wheel so that the contacting area between the spur and the recording sheet is minimized as long as possible, whereby the ink which may stick to the spur does not influence the recording sheet or other elements as long as possible.

However, if the environment where the ink jet recording system is used has a relatively high humidity, the spur may contact the inked surface of the recording sheet before the ink has not yet been fixed to the sheet completely, with the result that a relatively large amount of ink sticks to the spur, from which arises a risk that the recording sheet or other elements are smeared with the ink. Further, if an image having high density of pixels such as graphics or a color image is recorded on the recording sheet, since the relatively large amount of ink is transferred onto the recording sheet, the problem as mentioned above will occur. Further, recently, since the bubble jet recording head has particularly been made small-sized, the recording system itself tends to become compact. In this case, since the sheet feeding path is shortened, it is difficult to improve the fixing of the ink.

On the other hand, there remains room for improving the spur itself with regard to the conveying feature of the recording paper and the positional accuracy in association with the ejector roller and the platen. For example, the recent ink jet recording system is sometimes designed so that it can accommodate various recording papers such as normal recording papers, thicker envelopes or the like; in this case, the spur, ejector roller and platen must be designed and arranged so as to provide proper feeding of the sheet in dependence upon the various recording papers. Further, when the recording system is made small-sized, a member for supporting the spur often serves as another member constituting the recording system such as a cover of the recording system; in this case, the positional accuracy of the member will be important.

SUMMARY OF THE INVENTION

The present invention aims to eliminate the above-mentioned drawbacks, and an object of the present invention is to provide a recording system which improves the conveying feature of a recording medium by properly selecting a shape or configuration of spurs disposed in a recording medium feeding path and adapted to feed the recording medium, and which can improve the ink repelling feature and the endurance of spur cleaners when the spurs are used with the spur cleaners.

Another object of the present invention is to provide a recording system which improve the cleaning action for spurs and can minimize the contamination of a recording paper due to ink stuck to the spurs.

A further object of the present invention is to provide a recording system which can determine a distance between a spur and a member (for example, a platen or ejector roller) opposing to the spur with high accuracy, and can maintain such distance regarding a plurality of the spurs uniformly, thereby improving the conveying feature of the spurs.

A still further object of the present invention is to provide a recording system which keeps a recording paper away from a recording head and the like by positively holding the recording paper by means of spurs, thereby preventing the friction between the recording paper and the recording head and the like.

Another object of the present invention is to provide a recording system which can facilitate the assembling and disassembling of spur rollers and cleaning members for cleaning the spur rollers without degrading the positional accuracy thereof.

BRIEF DESCRIPTION OF THE DRAWINGS

FIG. 24A shows a condition that a recording medium does not reach a pair of ejector rollers and FIG. 24B shows a condition that the recording medium is being fed by the pair of ejector rollers.

DETAILED DESCRIPTION OF THE PREFERRED EMBODIMENTS

The present invention will now be fully explained in connection with embodiments thereof with reference to the accompanying drawings.

Figure 1:
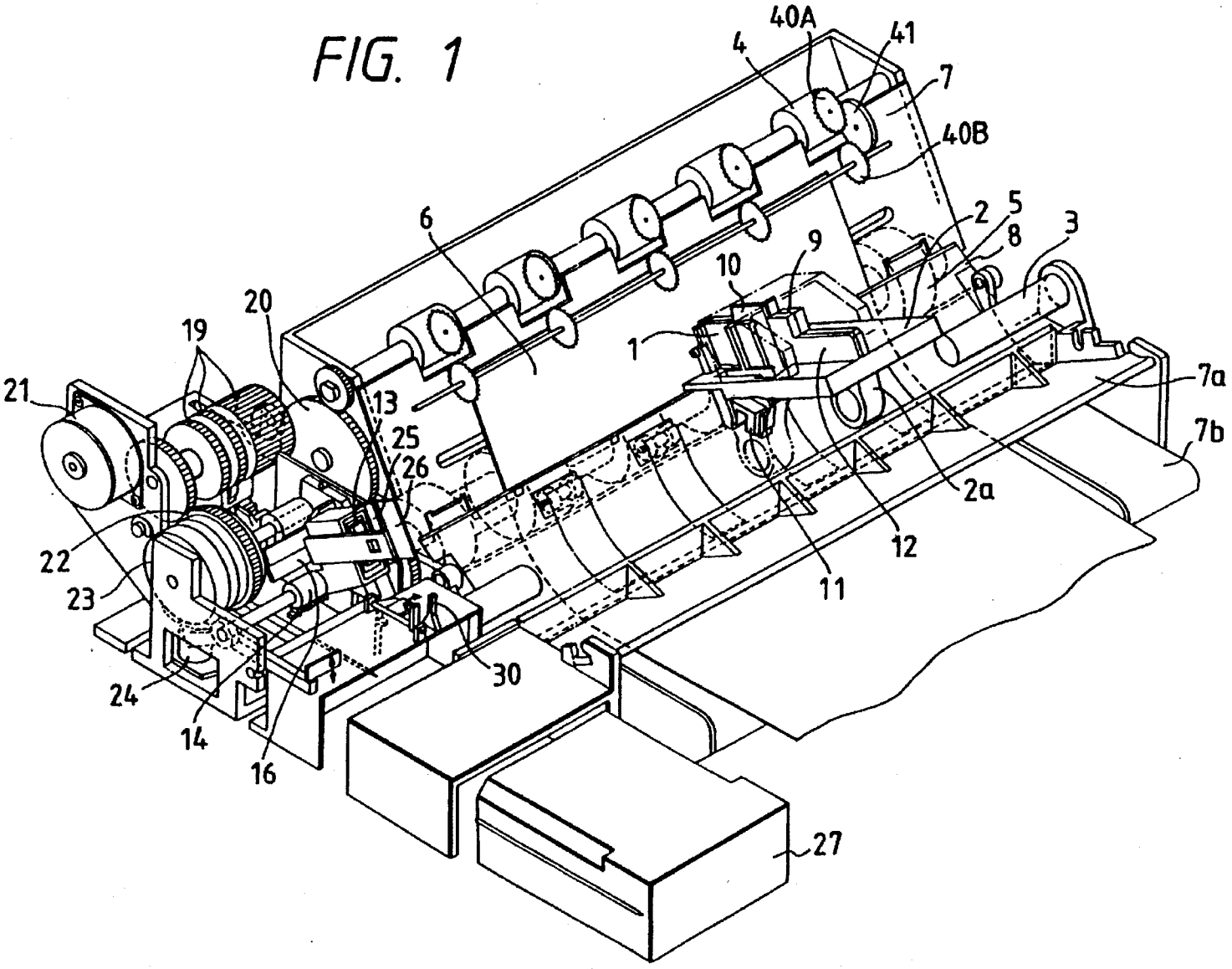
FIG. 1 is a perspective view of an ink jet recording system according to a preferred embodiment of the present invention, omitting a top cover.

FIG. 1 is a perspective view showing an embodiment of an ink jet recording system according to the present invention, with emitting a cover.

In FIG. 1, the reference numeral 1 denotes a recording head of chip type; and 2 denotes a carriage on which the recording head 1 is mounted for movement to perform a scanning operation by means of the recording head 1. On the carriage 2, there are provided a support member (described later) for detachably mounting the recording head 1, and a cover member (shown by a dot and chain line in FIG. 1) for protecting a substrate on which a head driving circuit and the like are printed.

The recording head 1 is provided at its front end with 64 discharge openings to which corresponding ink passages are connected. Further, a common liquid chamber for supplying ink to the ink passages is disposed in the head behind the ink passages. Regarding each of the ink passages corresponding to the 64 discharge openings, there are provided an electrical/thermal converter for generating discharging energy used to discharge an ink droplet from each discharge opening, and electrode wirings for supplying the electric power to the electrical/thermal converter.

These electrical/thermal converters and electrode wirings are formed on a silicon substrate by means of a film forming technique, and partition walls and a top plate made of resin, glass material and the like are laminated on the substrate, whereby the discharge openings, ink passages and common liquid chamber are formed. Behind the electrical/thermal converters of the recording head, a driving circuit for driving the electrical/thermal converters in response to a recording signal is arranged in a form of a printed circuit.

On the carriage 2, behind the recording head 1, a connector substrate 12 is disposed through a connector 9. On the connector substrate 12, the connector 9 for connection to the recording head 1 and a connector for connection to a flexible cable extending from a control circuit in the body of the recording system are arranged. Further, on the connector substrate 12, there are arranged capacitors, resistors and the like, by which the reduction in the power voltage supplied through the flexible cable and the noise mixing regarding the signals are compensated. In addition, the connector substrate 12 is supported on a slide member as will be described later so that it can slide in response to the opening and closing of the cover member to disconnect and connect the connector 9 to the terminal of the recording head 1.

The carriage 2 slidably and rotatably engages, through its engagement portion 2*a*, with a guide shaft 3 which extends through an area longer than a width of a recording paper, perpendicular to a recording paper feeding direction. Further, the carriage 2 is connected to a belt (not shown) extending in parallel to the guide shaft 3, which belt is driven by a carriage motor (not shown) to shift the carriage 2 along the guide shaft 3 or perform the scanning operation by means of the recording head 1. Further, the carriage 2 and recording head 1 can be rotated around the guide shaft 3 by their own weights, which weights serve to urge a paper holder plate 8 (described later) through a sliding member arranged on the carriage 2 and slidingly moving on the paper holder plate. Thus, the recording head 1 can be maintained to be spaced apart from any recording paper by a predetermined distance in dependence upon a thickness of the recording paper.

The recording paper 6 supplied from a paper supply cassette (not shown) or an manual insert is introduced into the recording system through a paper supply inlet defined by an upper paper guide 7*a* and a lower paper guide 7*b*. The upper paper guide 7*a* is continuous to the paper holder plate 8 having an arcuate portion. The paper holder plate 8 is arranged to urge the recording paper against paper feed rollers 5 and is made of material which generates a friction force between the paper holder plate and the recording paper smaller than a friction force between the paper feed rollers and the recording paper. Further, the lower paper guide 7b extends up to a position where the paper feed rollers 5 are disposed in parallel to the paper holder plate 8.

In this way, the recording paper 6 supplied from the paper supply inlet is advanced upwardly of the recording system line by line in response to the rotation of the paper feed rollers. In this case, the recording paper 6 is slidingly moved on a platen 7 while maintaining a predetermined distance between the paper and the recording head by means of the paper holder plate 8 and the platen 7.

The recording head 1 performs one line recording by discharging ink droplets onto a recording area of the opposing recording paper during the scanning operation thereof; by alternately repeating such one line recording and the one line feeding of the recording paper, the one line recordings are successively effected to obtain an image such as a character.

The recording paper 6 on which the image was formed is ejected onto an ejector tray (not shown) by means of ejector rollers 4 and spurs 40A, 40B disposed in the paper feeding path at a downstream side of the platen. Five pair of spurs 40A, 40B are provided in correspondence to five ejector rollers 4, and a spur cleaner is interposed between the spurs in each pair. Incidentally, members for supporting the spurs and spur cleaners are omitted in FIG. 1.

Each spur 40A applies an urging force to the corresponding ejector roller 4 through the recording paper, and the spurs 40B are arranged so that they cooperate with the platen to define the paper feeding path therebetween. The ejector rollers 4 are rotated at a peripheral speed faster than that of the paper feed rollers 5, so that a portion of the recording paper 6 situated in the recording area is tensioned upwardly to prevent any inconvenience of the recording paper in the recording area, such as the floating of the paper from the platen.

In the vicinity of a home position in an area continuous to the scanning area for the recording head 1, a series of elements for performing the discharge recovering operation are arranged. That is to say, a blade 26 for removing water droplets, dust and the like from a discharging surface (on which the discharge openings are formed) by a wiping action, an absorbing member 25 for mainly removing the water droplets from the discharging surface by an absorbing action, and a cap 13 for capping the recording head to perform the sealing of the discharging surface, idle discharge and ink suction are provided. These elements are integrally supported by a moving support member 14 to move toward and away from the shifting area of the recording head 1, and are driven at the proper timing.

Further, the ink suction in the cap 13 is effected by a pump 24 communicating with the cap 13 through a hollow portion in the moving support member 14 and a tube. In capping operation by means of the cap 13, by engaging holes formed in a cap arm 17 attached to a side surface of a holding member of the cap 13 by corresponding projections formed carriage 2, the recording head 1 is prevented from being rotated rearwardly, thereby ensuring the capping of the cap 13 against the discharging surface.

The rotations of the paper feed rollers 5 and ejector rollers 4, the operation of the discharge recovering mechanism ( i.e., the toward-and-away movement of the cap 13, blade 26 and absorbing member 25) and the suction operation of the pump 24 are effected by the use of the rotational driving force of a feed motor 21. More particularly, the rotational driving force of the feed motor 21 attached to a portion of a frame of the recording system is firstly transmitted to a transmit switching gear train 19. In this gear train 19, by shifting a selection gear (not shown) in synchronous with the operation of the carriage 2, i.e., the scanning movement of the recording head 1, the movement of the head to the home position and to the discharge recovering mechanism and the stopping of the recording head in the home position and the like, each gear is selectively switched. Thereby, the rotation of each gear in the gear train 19 is transmitted to the paper feed rollers 5 and the ejector rollers 4 through an intermediate gear 20, and eventually is transmitted to the cap 13 and the like through a cam 16, and further transmitted to the pump 24 through a pump gear 22 and a pump cam 23.

The ink is supplied to the recording head 1 from an ink cartridge 27 mounted on the recording system through a flexible tube movable in response to the movement of the carriage 2. Further, the position of the carriage 2 is detected by counting the number of steps of the carriage motor on the basis of a reference defined by an engagement position between a home position sensor 11 mounted on the carriage 2 and a home position detecting flag disposed in the vicinity of the extremity of the moving range of the carriage 2.

Figure 2:
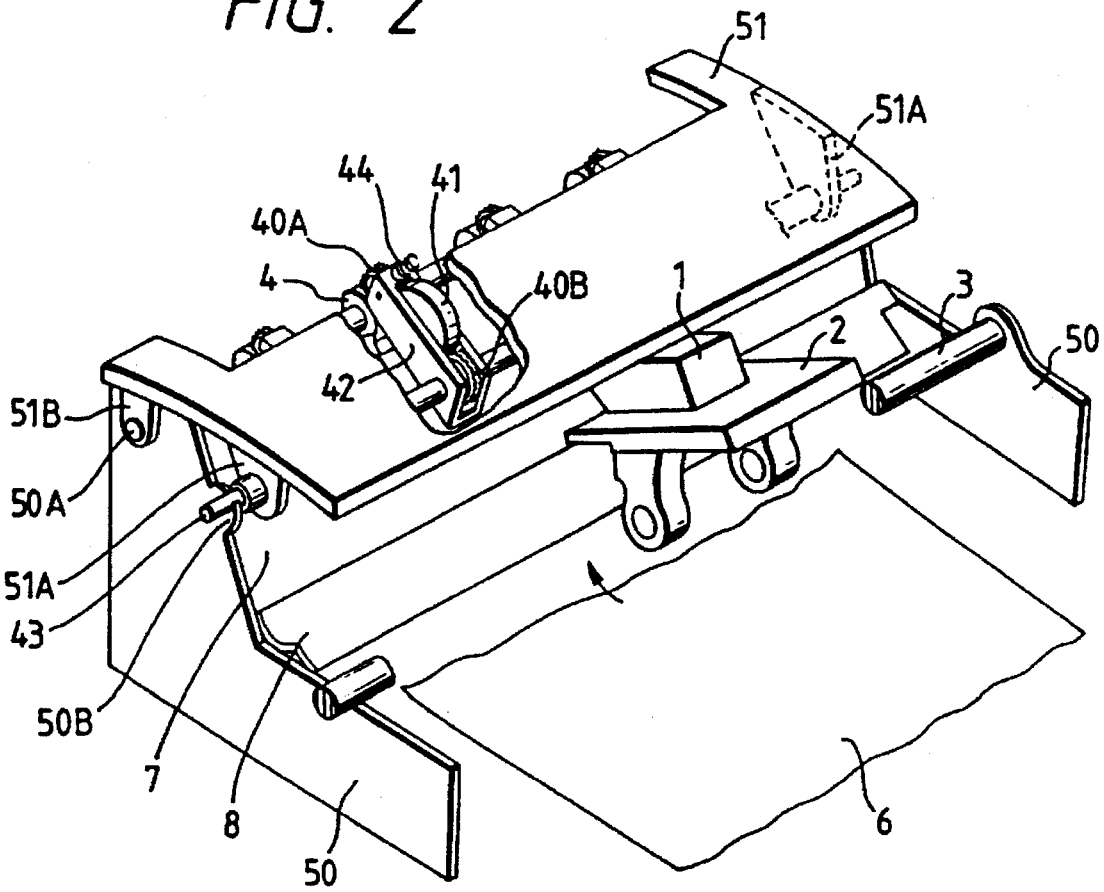
FIG. 2 is a perspective view similar to FIG. 1, but with the top cover.

FIG. 2 is a perspective view of the recording system with a top cover as a portion of the cover of the system mounted on the recording system, and particularly shows the spurs and the spur cleaner.

Figure 3:
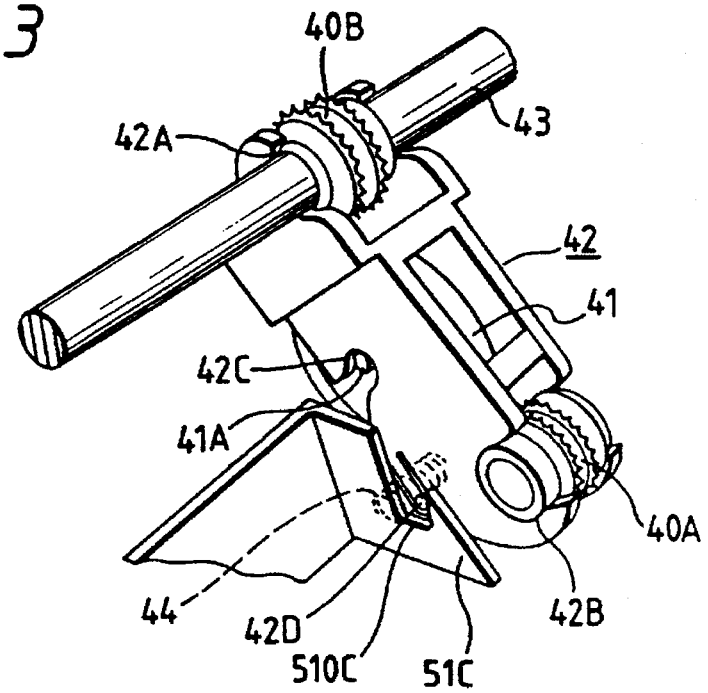
FIGS. 3 and 4 are perspective views showing a spur and a spur cleaner of the recording system according to the preferred embodiment.

In FIG. 2, the reference numeral 51 denotes a top cover forming a part of the cover of the recording system; and 43 denotes a spur shaft for rotatably supporting upstream spurs 40B of the paired spurs 40A, 40B arranged in the recording paper feeding path. As seen in FIG. 3, the spur shaft 43 is supported by support members 51A formed on the back surface of the top cover 51.

By adopting such a spur supporting arrangement, it is possible to prevent the positional deviation of the plural spurs 40B toward the platen 7; otherwise, conventionally, the spurs independently mounted on the cover were liable to deviate from their normal positions due to the bending of the cover and the like. As a result, it is possible to uniformly maintain the distances between the platen 7 and the respective spurs 40B, thus permitting the good feeding of the recording paper.

Figure 4:
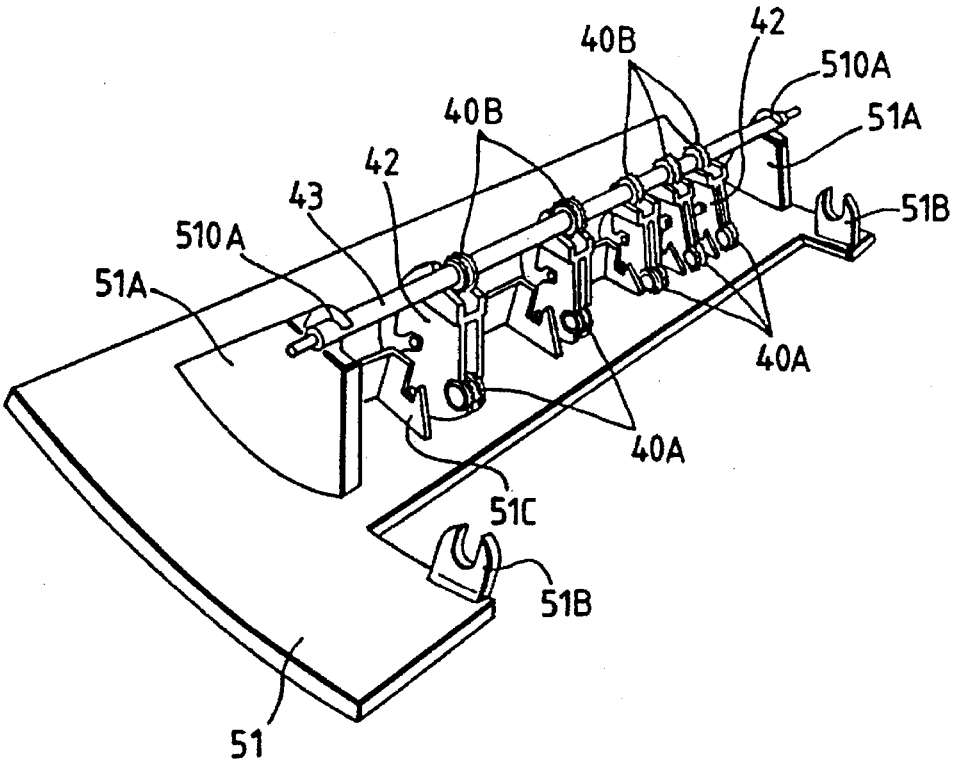

As seen in FIGS. 3 and 4, the upstream spur 40A and the associated spur cleaner 41 are rotatably supported by a spur holder 42 which is in turn rotatably supported by the spur shaft 43 and is urged toward the corresponding ejector roller 4 by means of a coil spring 44 disposed between the top cover 51 and the holder 42. Due to this urging action, the spur 40A is urged against the corresponding ejector roller 4 with the interposition of the recording paper.

The top cover 51 is mounted on the recording system through lugs 51B formed on the back surface of the top cover on both sides thereof and the above-mentioned spur shaft 43. More particularly, in mounting the top cover 51 to the recording system, first of all, the lugs 51B are fitted on bosses 50A formed on side frames 50 of the recording system, and thereafter, by rotating the top cover 51 around the bosses, both end portions of the spur shaft 43 are snappingly fitted into corresponding recesses 50B formed in the side frames 50. The recesses 51B are formed in the vicinity of the platen 7. With the arrangement wherein such top cover 51 is mounted on the recording system, in particular, with the arrangement wherein the spur shaft 43 is fitted into the fixing portion of the recording system in the vicinity of the platen 7, it is possible to determine the distances between the platen 7 and the respective spurs 40B uniformly and with high accuracy. Consequently, the floating of the recording paper in an area in the paper feeding path between the paper holder plate 8 and the ejector rollers 4 and the spurs 40A can be prevented, thus permitting the good feeding of the recording paper.

FIGS. 3 and 4 are perspective views clearly showing the supporting mechanism for the spur and the spur cleaner shown in FIGS. 1 and 2.

First of all, as shown in FIG. 3, the spur cleaner 41 is mounted on the holder 42 by fitting a rotary shaft 41A of the spur cleaner into shaft receiving recesses 42C formed in the holder 42. Each shaft receiving recess 42C is a roughly dimensioned recess having a diameter larger than that of the rotary shaft 41A, and an entrance portion of each recess 42C has a width slightly smaller than the diameter of the rotary shaft 41A, with the result that the spur cleaner 41 can displace its rotary shaft within a range permitted by the dimension of the shaft receiving recesses 42C, but cannot escape from the holder 42. A shaft portion of each downstream spur 40A opposing the corresponding ejector roller 4 is rotatably fitted into recesses 42B formed in the holder 42.

Further, each upstream spur 40B opposing the platen 7 is slidably and rotatably fitted on the spur shaft 43, and then is mounted on the holder 42 by rotatably fitting the spur shaft 43 into shaft receiving recesses 42A formed in the holder 42 while positioning the spurs 40B in position in the holder 42.

Thereafter, as shown in FIG. 4, the spur shaft 43 is fitted into shaft receiving recesses 510A formed in the support members 51A disposed on the back surface of the top cover 51 on both side thereof. Then, as seen in FIG. 3, a projection 42D formed on the holder 42 is inserted into a locking recess 510C formed in a locking member 51C disposed on the back surface of the top cover 51, in opposition to the elastic force acting on the projection. In this way, the position of the spur holder 42 with respect to the top cover 51, and accordingly, the positions of the spurs 40A, 40B and the spur cleaner 41 with respect to the top cover 51 are determined. In this case, the spur holder 42 can be rotated around the spur shaft 43 within a range defined by the movement of the projection 42D in the locking recess 510C. However, when the top cover 51 is mounted on the recording system, the holder is biased toward one direction by means of the spring 44 as mentioned above, whereby the spur 40A urges the corresponding ejector roller 4.

Figure 5:
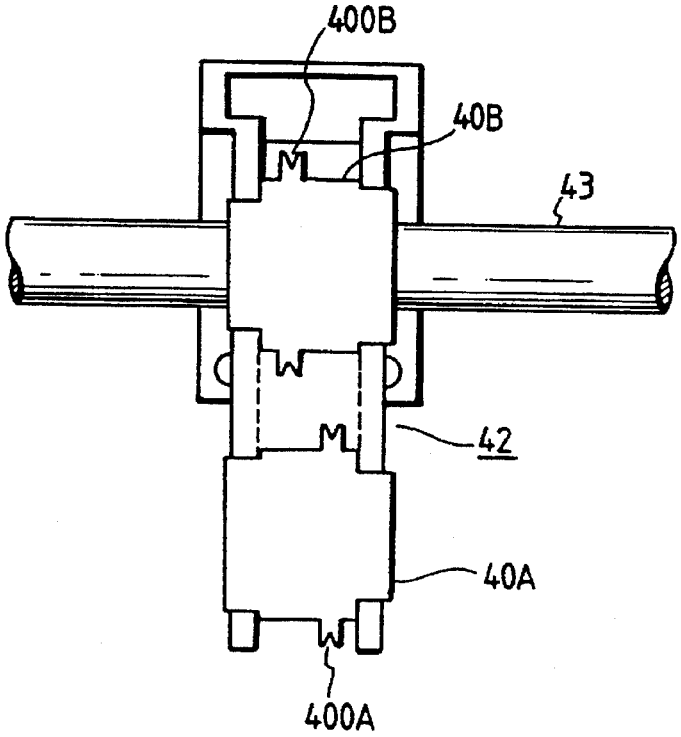
FIG. 5 is a sectional view of a spur holder of FIG. 3 looking at from a back side thereof.

FIG. 5 is a sectional view of the spur holder looking at from the back side thereof (the spur cleaner is omitted).

As shown in FIG. 5, the spurs 40A and 40B are arranged in such a manner that teeth 400A of the spur 40A are offset from teeth 400B of the spur 40B in a longitudinal direction of the spur shaft 43. Consequently, since the spur cleaner 41 contacts the teeth 400A and 400B at different positions, the spur cleaner can more effectively absorb or remove the ink from these teeth 400A, 400B in comparison with the case where the spur cleaner contacts these teeth at the same position.

Figure 6A:
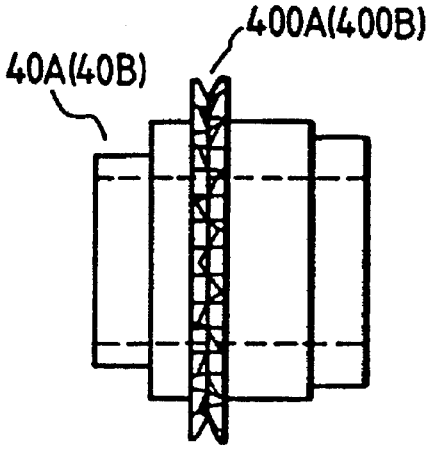
FIGS. 6A and 6B are a plan view and a side view of the spur of the recording system according to the preferred embodiment, respectively.
Figure 6B:
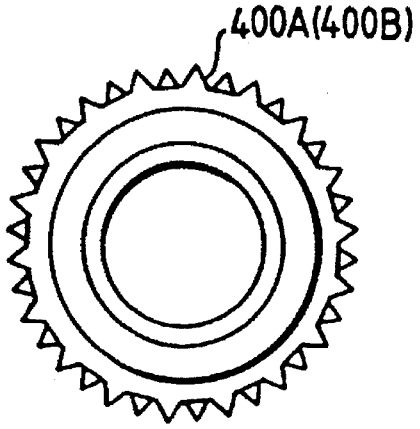

FIGS. 6A and 6B are a plan view and a side view of the spur 40A (or 40B), respectively.

As shown in FIGS. 6A and 6B, the teeth 400A (400B) are arranged in two rows, and the teeth in each row are staggered with the teeth in the other row. Consequently, by arranging the teeth in two rows, the urging force of the spur acting on the cleaner 41 is smaller than that in the case where the teeth is arranged in a single row, thereby lengthening the service life of the cleaner 41. Further, in comparison with the teeth arranged in the single row, the spur having the teeth arranged in two rows can hold down or urge the recording paper in a wider area, thus ensuring the positive holding of the recording paper.

Further, since the teeth in each row are staggered with the teeth in the other row, the pitch between the teeth in the whole spur becomes smaller, with the result that, when the recording paper is inserted between the spurs and the platen or between the spurs and the corresponding ejector roller during the feeding of the recording sheet, the recording sheet will be difficult to enter into the space between two adjacent teeth, thus stabilizing the feeding of the recording sheet.

Incidentally, the arrangement of the teeth is not limited to two rows, any plurality of rows such as three rows or more can be adopted. For example, when the teeth are arranged in three rows, the pitch between the adjacent teeth in the first row may be equally divided by the teeth in the second and third rows. Further, the spur shown in FIGS. 6A and 6B can be easily manufactured by the molding operation.

Figure 7:
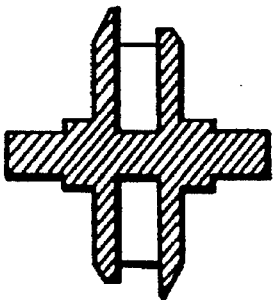
FIG. 7 is a sectional view showing an alternative form of the spur of FIGS. 6A and 6B.

FIG. 7 is a sectional view showing a spur in an alterative form. In this example, the teeth are also arranged in two rows and the teeth in each row are staggered with the teeth in the other row, as similar to the previous embodiment. The spur of FIG. 7 differs from the spur of FIGS. 6A and 6B in the point that two rows are spaced apart from each other by a predetermined distance. With this arrangement, since the sliding mold is required in the molding operation, the molding operation becomes relatively complex, but it is relatively easily to form the teeth in three or more rows.

Figure 8:
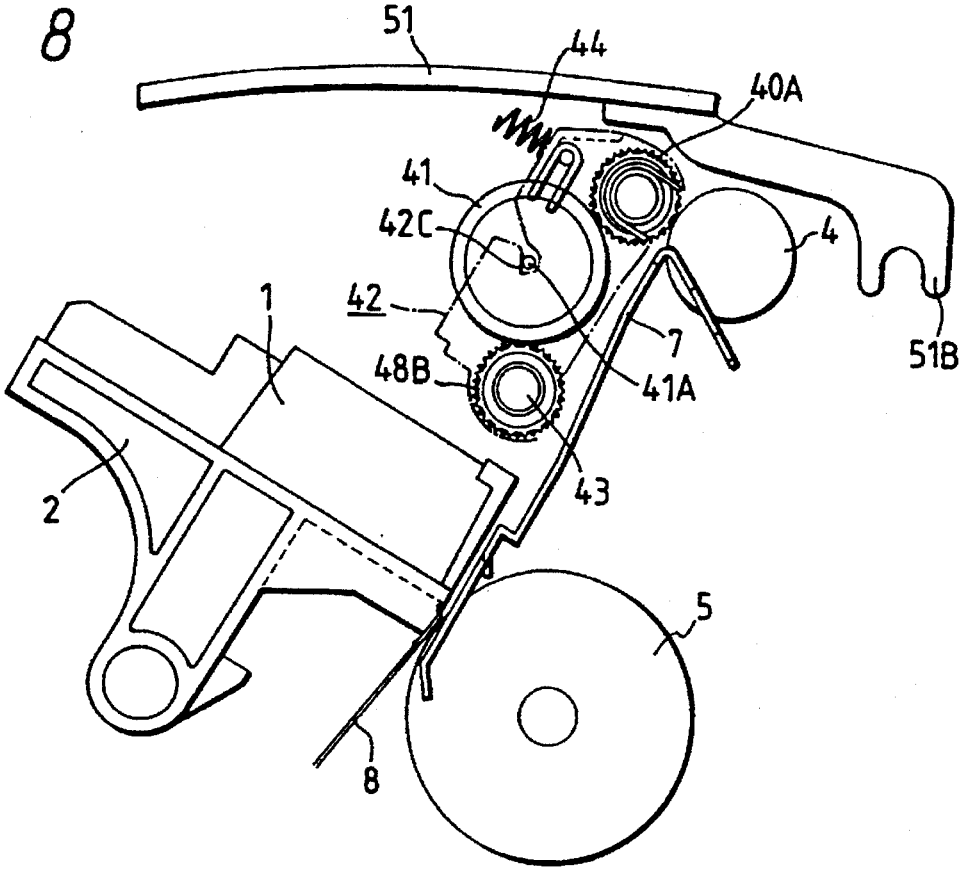
FIG. 8 is a side sectional view of the recording system according to the preferred embodiment.

FIG. 8 is a sectional view of the recording system shown in FIGS. 1 and 2, and particularly shows the details of the spurs 40A, 40B and the spur cleaner 41.

As explained in connection to FIGS. 2 and 3, the positions of the spurs 40A, 40B are determined by the spur holder 42, and the spur cleaner 41 is held between the spurs by means of the spur holder 42. With this arrangement, when the ejector rollers 4 are rotated, the spurs 40A contacting the ejector rollers are also rotated, and the rotation of each spur 40A is transmitted to the corresponding spur 40B through the rotation of the spur cleaner 41 engaging with both spurs 40A and 40B, thus rotating the spur 40B. In this way, by rotating the spurs 40B opposing the platen 7, the bending of the recording paper is prevented when a leading end of the recording paper is introduced between the platen 7 and the spurs 40B. It is desirable that the peripheral rotation speeds of the spurs 40B are the same as those of the spurs 40A and ejector rollers 4 to perform the good feeding of the recording paper. According to the above-mentioned construction regarding the spurs 40A, 40B and spur cleaner 41, since the spur cleaner 41 acts as an idler, such same peripheral speeds can be attained.

The biasing force for engaging the spur cleaner 41 by the spurs 40A, 40B is obtained by the weight of the spur cleaner itself. That is to say, although the spur cleaner 41 is rotatably supported by fitting the rotary shaft 41A of the spur cleaner 41 into the shaft receiving recesses 42C of the holder 42, since these shaft receiving recesses 42C are roughly dimensioned recesses with respect to the rotary shaft 41A, the rotary shaft 41A can be shifted in the shaft receiving recesses. Accordingly, the position of the rotary shaft 41A is determined by the engagement between the spur cleaner 41 and the spurs 40A, 40B effected by the weight of the spur cleaner. In other words, the biasing force for engaging the spur cleaner 41 by the spurs 40A, 40B is obtained only by the weight of the spur cleaner itself.

With the arrangement as mentioned above, in order to obtain the above-mentioned biasing force, it is not required to provide a specific urging means such as a spring; and further, since the spur cleaner 41 can engage by the spurs at any position on its peripheral surface, it is not required that the spur cleaner be accurately manufactured, thus reducing the cost of the whole recording system.

By the way, with the above-mentioned arrangement regarding the spurs and spur cleaner, the effective result is obtained when the relationship between the positions of three shafts and the weight of the spur cleaner is within a predetermined range. In other cases, for example, when the spurs 40B are rotated by the feeding movement of the recording paper, the spur cleaner 41 is often floated due to such rotation, thus causing the poor engagement between the spur cleaner and the spurs. In such a case, the ink stuck to the spurs cannot be removed adequately, with the result that the subsequent recording paper is smeared with the ink.

Figure 9:
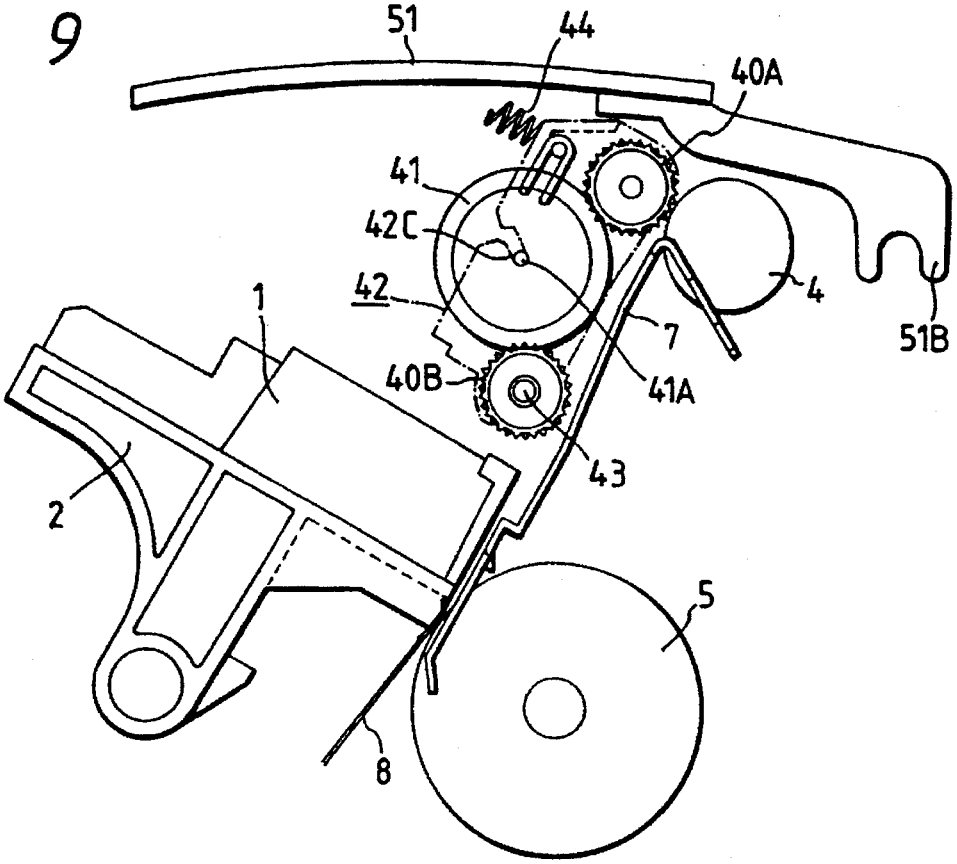
FIG. 9 is a side sectional view of an ink jet recording system according to another embodiment of the present invention.

An example of an arrangement for coping with the above-mentioned inconvenience is shown in FIG. 9.

As shown in FIG. 9, each shaft receiving recess 42C is constituted by an elongated slot slidably and rotatably engaging by the rotary shaft 41A. A longitudinal center line of each elongated slot coincides with a portion of a circle concentric to the spur 40A. Further, the positional relation between the spur 40A and the spur cleaner 41 is so selected that these elements are overlapped by a predetermined amount in the engagement position. That is to say, when the spur cleaner 41 is engaged by the spur 40A, the teeth of the spur 40A penetrate into the outer surface of the cleaner 41.

With the arrangement as mentioned above, firstly, since the spur and the spur cleaner are overlapped by the predetermined amount in the engagement position, the accuracy of the diameter of the spur cleaner is not critical to keep the engagement between the spur and the spur cleaner. Secondly, since the shaft receiving recesses 42C are formed as the predetermined elongated slots, the biasing force for urging the spur cleaner 41 toward the spur 40B is obtained by the rotation of the spur 40A, whereby the spur cleaner 41 and the spur 40B can also be overlapped by a predetermined amount in the engagement position.

Although it is difficult to form the spur cleaner in the true or complete cylindrical shape due to the feature of the material of which the spur cleaner is made, even if the spur cleaner is distorted, such distortion is compensated by the shifting movement of the spur cleaner 41 in the shaft receiving recesses 42C; particularly, in a portion of the spur cleaner distorted in a direction to increase the diameter of the cleaner, the spur cleaner 41 is shifted away from the spur 40B, thus preventing the overload between the spur cleaner and the spur 40B. Consequently, the whole load can be more reduced in comparison with the case where the position of the spur cleaner 41 is fixed.

Further, when either spur 40A or 40B is driven, the floating of the spur cleaner 41 can be prevented by the presence of the elongated slots. In addition, also with this arrangement, the cleaner 41 can serve as an idler, with the result that the spurs 40B are also rotated synchronously with the rotations of the ejector rollers 4 (i.e., not stopped during the feeding of the recording paper), thus preventing the contamination of the recording paper due to the stopping of the spurs.

In the arrangement shown in FIG. 9, the position of the spur 40B with respect to the platen 7 differs from that shown in FIG. 8. That is to say, in FIG. 8, the platen 7 is caved in or depressed at a predetermined position at a downstream side of a position where the platen is opposed to the recording head 1; whereas, in FIG. 9, the teeth of the spur 40B is protruded in the cave-in portion of the platen by about 1.5 mm at the most. With this arrangement, the recording paper fed on the platen 7 is deflected away from the recording head 1, at a paper portion situated at a downstream side of the platen portion opposing the recording head 1. Due to such deflection and a tension force (created by such deflection) acting on the recording paper, the floating and bending of the recording paper in the vicinity of the recording head 1 can be prevented.

Figure 10:
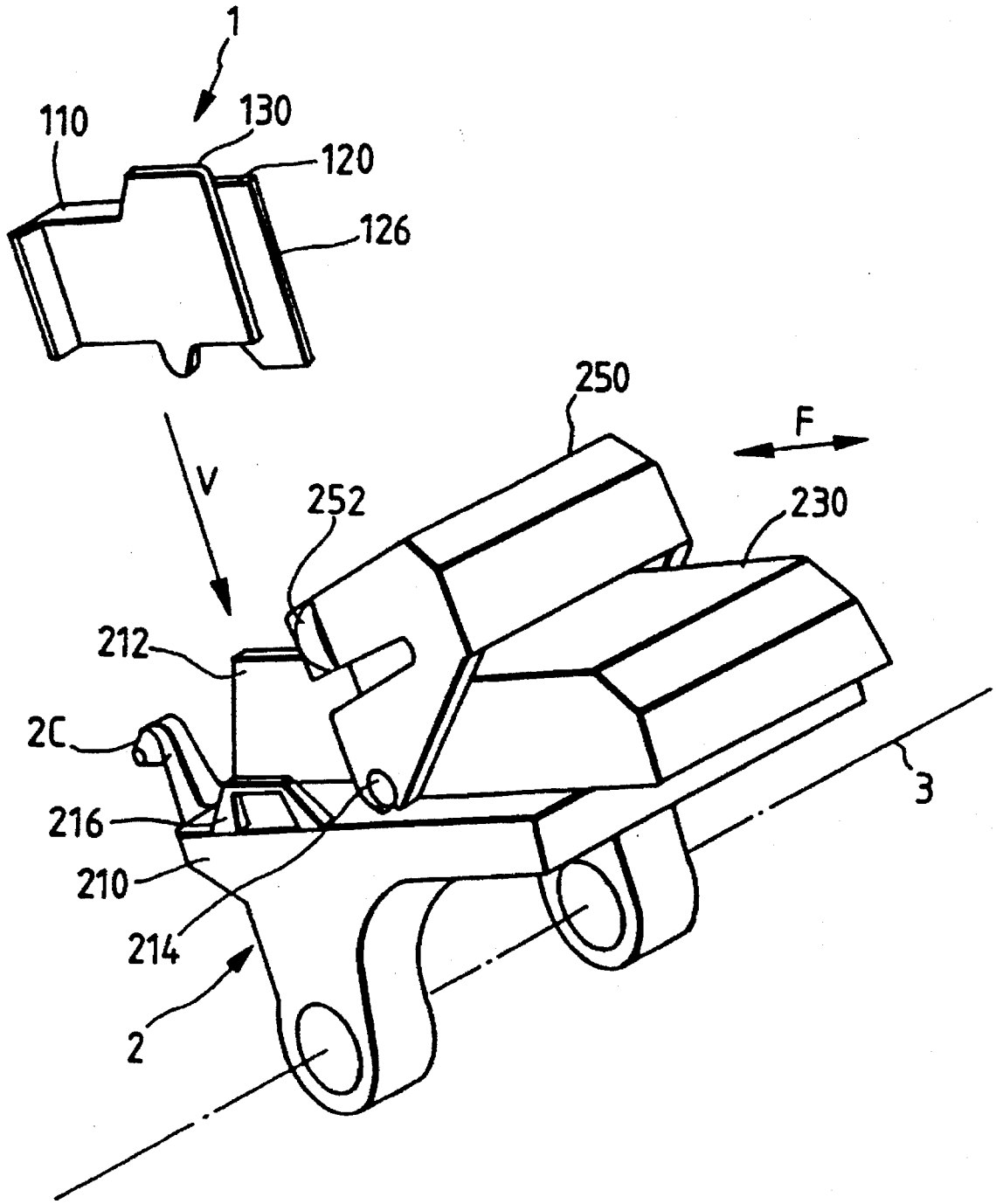
FIG. 10 is a perspective view showing a carriage and associated elements applied to the recording system according to the present invention.

FIG. 10 is a perspective view of the carriage and associated elements of the recording system.

A head chip 110 includes a plurality of discharge openings formed in a discharging surface opposing the recording paper, ink passages communicated with the discharge openings, discharge energy generating elements such as electrical/thermal converters associated with the corresponding ink passages, and a common liquid chamber communicated with all of the ink passages and adapted to supply ink to the ink passages. A head wiring substrate 120 is provided with a wiring portion for supplying the electric power to the discharge energy generating elements, and has a connector 126 at its one end. The reference numeral 130 denotes a support substrate for supporting the head chip 110 and the head wiring substrate 120. The recording head having such construction is attached to the carriage 2 from a direction shown by the arrow V in FIG. 10.

In the carriage 2, a carriage body 210 has a side support plate 212 for supporting a side surface of the head support substrate 130, and a pin 214 acting as an axis around which a head cover 250 is rotated. A connector slider 230 holds the connector substrate 120 having a connector portion 9 for connection to the connector 126 of the head 1, a connector portion for connection to a flexible cable capable of transmitting and receiving signals between a control portion of the recording system and the head 1, and noise reducing resistors. The connector slider can be slidably shifted with respect to a direction shown by the arrow F in FIG. 10 with respect to the carriage body 210.

The head cover 250 protects the recording head 1 (particularly, the wiring substrate 120 thereof) from the inadvertent operator's touch, and can be rotated around the pin 214 to cover or open the recording head 1. By engaging the head cover 250 with the connector slider 230 and by shifting the connector slider 230 in the direction F in response to the rotation of the head cover 250, the connector portion of the connector slider 230 can be connected to or disconnected from the connector 126 of the recording head 1. Further, when a projection 252 formed on the head cover 250 is fitted into a cover locking member 216 formed on the carriage body 210, the recording head 1 is fixed with respect to the carriage 2.

Next, a method for fixing the recording head 1 to the carriage 2 will be explained.

Figure 11A:
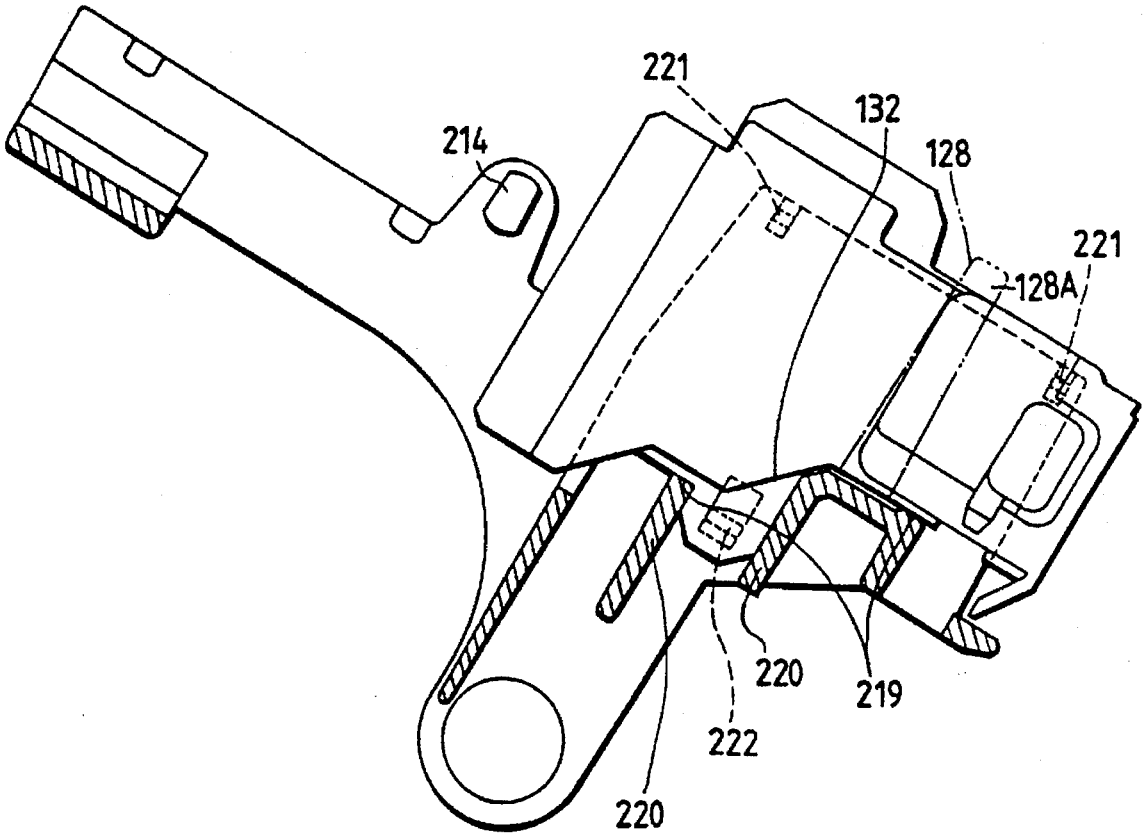
FIGS. 11A and 11B are a side sectional view and a plan view of the carriage on which a recording head is mounted, omitting a head cover and a connector slider, respectively.
Figure 11B:
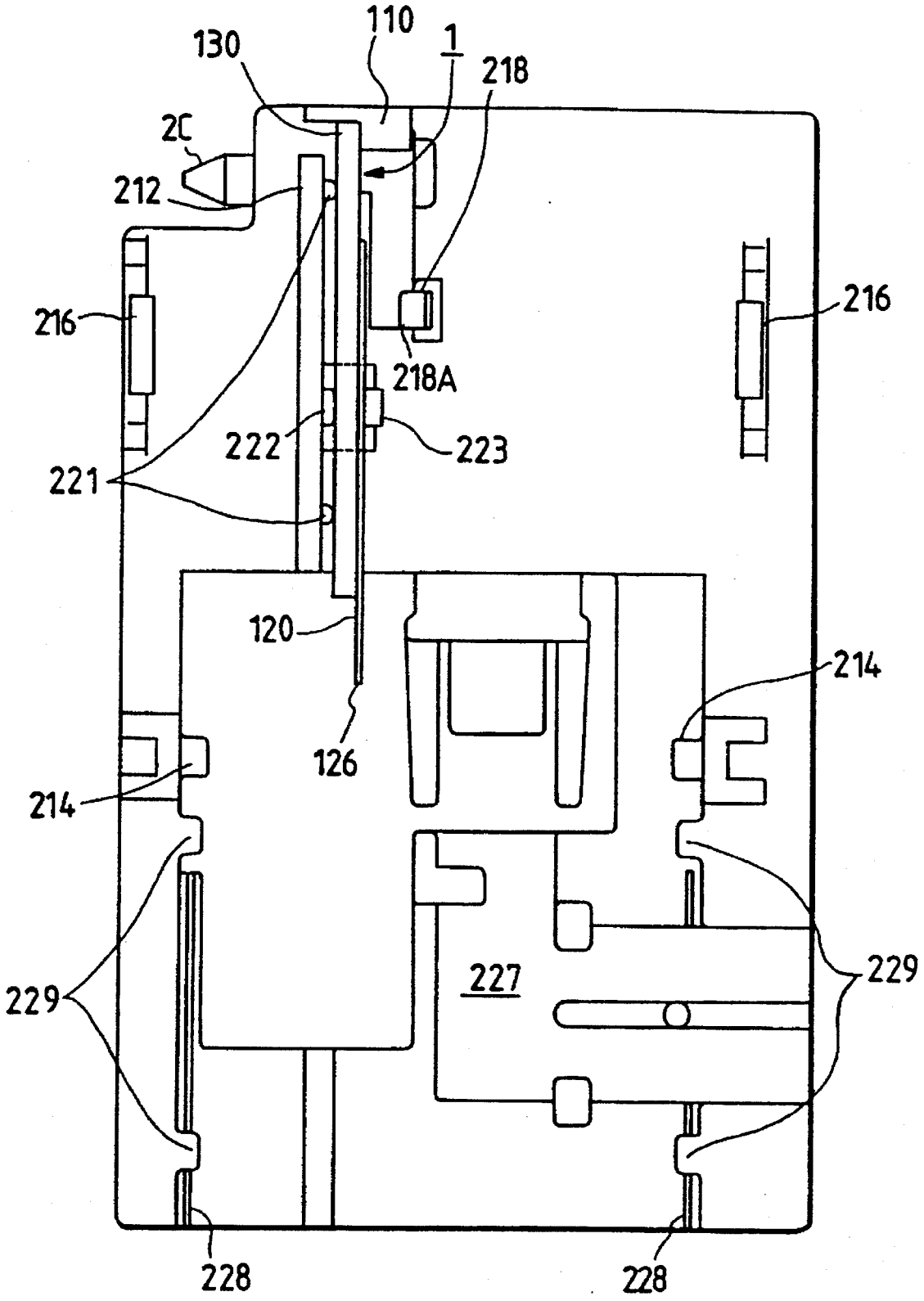

FIGS. 11A and 11B are side sectional view and a plan view showing the carriage 2 on which the recording head 1 is mounted, respectively, with omitting the head cover 250 and the connector slider.

The reference numeral 218 denotes a spring member integrally formed on the carriage body 210 for temporarily locking the recording head 1, which spring member has a tip pawl 218A by which the recording head 1 is latched. The reference numeral 219 denotes lower locking portions for fixing the recording head 1; and 220 denotes a locking portion for engaging by a protruded portion 132 formed integrally with the support substrate 130 to fix the recording head 1 at its front and back sides thereof. The reference numeral 221 denotes two projections formed on the side support plate 212 to engage by an upper side portion of the recording head 1; and 222 denotes a projection disposed to engage by a lower side portion of the recording head. The reference numeral 223 denotes a spring member protruded from the carriage body 210 to oppose the projection 222, which spring member urges the recording head 1 against the projection 222 when the recording head is mounted on the carriage.

Incidentally, in FIG. 11B, the reference numeral 228 denotes rails on which the connector slider 230 is slidably shifted; and 229 denotes projections for preventing the connector slider from detaching from the carriage. Further, the reference numeral 227 denotes a recessed portion in which an end of an ink supply tube communicating with the ink cartridge 27 (described later fully) is disposed.

Figure 12A:
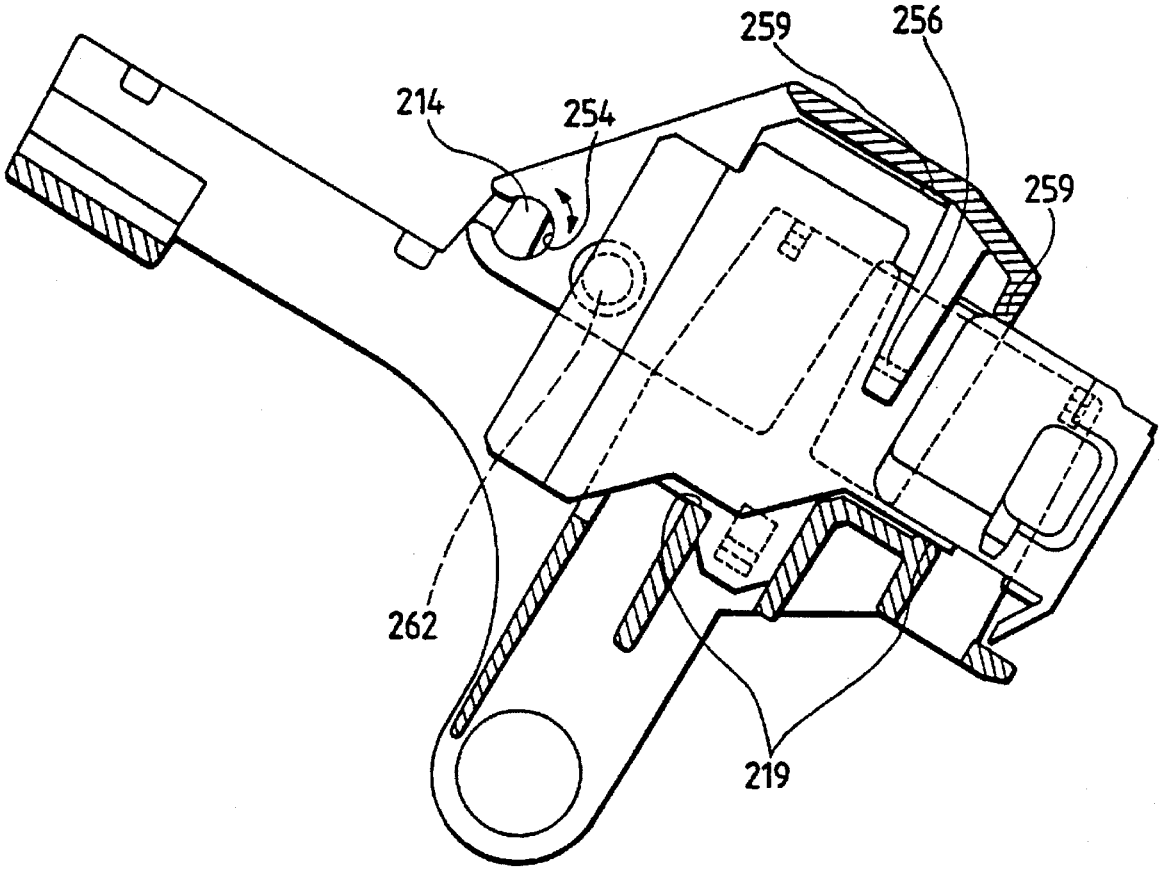
FIGS. 12A and 12B are a side sectional view and a plan view of the carriage on which a recording head and a head cover are mounted, with emitting a connector slider, respectively.
Figure 12B:
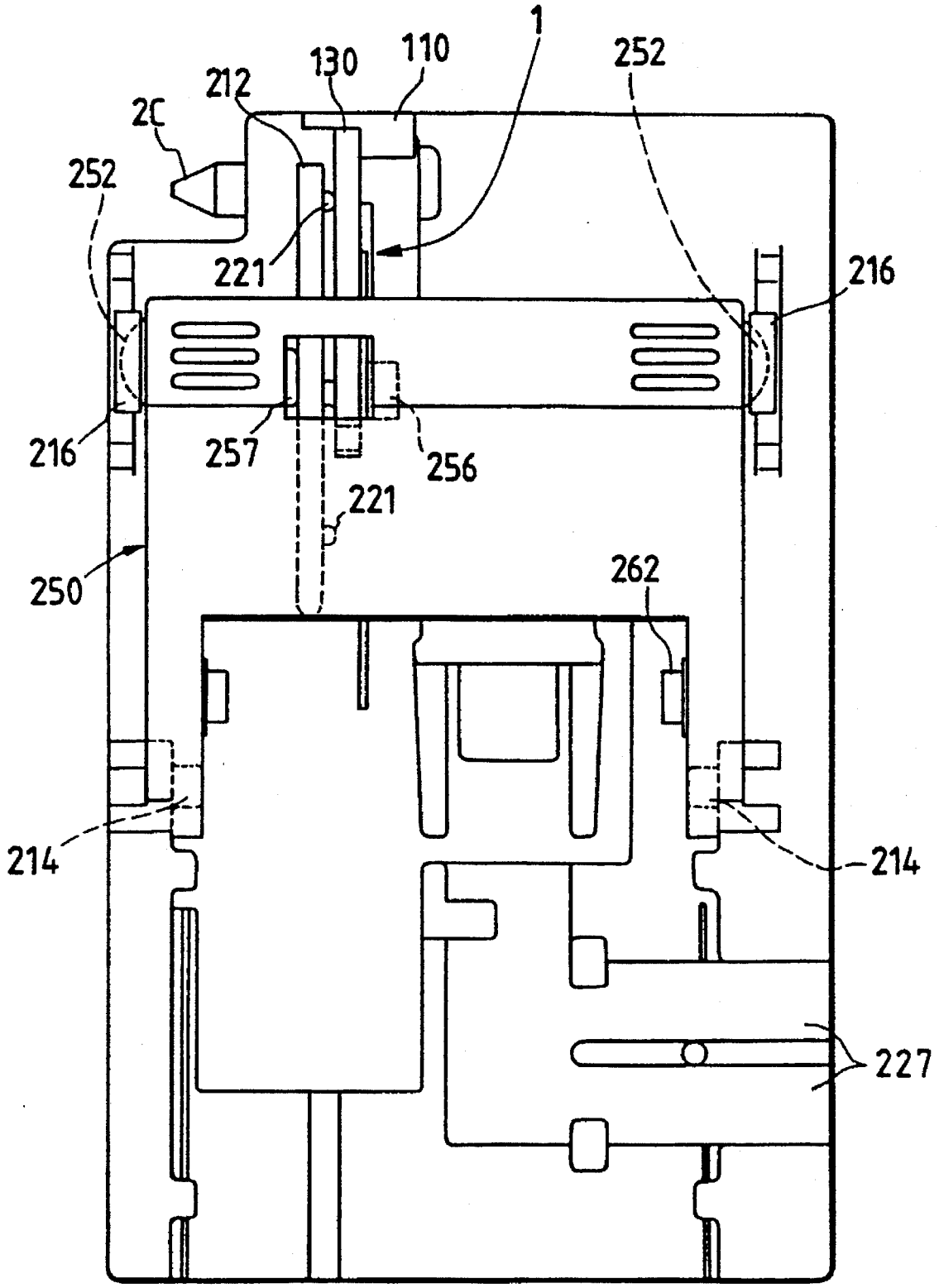

FIGS. 12A and 12B are a side sectional view and a plan view of the carriage in a condition that the recording head 1 is covered by the head cover 250, respectively, with omitting the connector slider 230 for the simplicity's sake.

Pin receiving portion 254 can receive the pins 214 formed on the carriage body 210, and, when the pins are received in these pin receiving portions, the head cover 250 can be rotated around the pins 214. The reference numeral 256 denotes a spring member protruded downwardly from an upper surface of the head cover 250 for urging the side surface of the recording head 1 to abut the recording head 1 against the protrusion 221 of the side support plate 212, thus fixing the recording head at its side surface. The reference numeral 257 denotes a supporting portion protruded from the head cover 250 for supporting the side support plate 212 in opposition to such urging force.

The reference numeral 259 denotes an upper portion fixing protrusion formed on the head cover 250 for urging the recording head 1 downwardly to abut the latter against the lower portion fixing locking portions 219 when the protrusion 252 is received in the cover locking member 216. Further, the reference numeral 262 denotes protrusions for engaging by the connector slider 230 to shift the latter in response to the rotation of the head cover 250, as will be described later.

Figure 13:
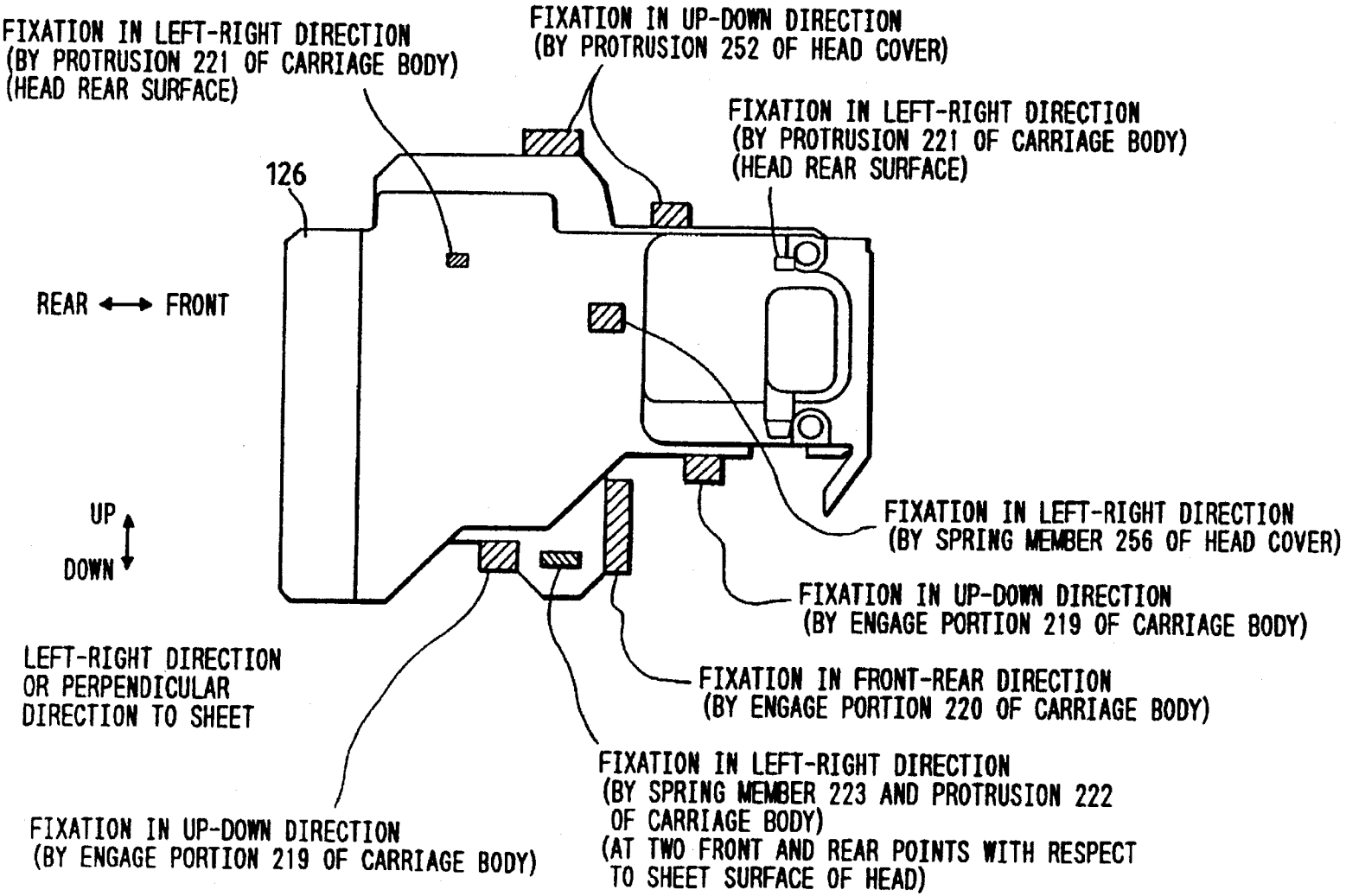
FIG. 13 is an explanatory view for explaining a fixing and positioning condition of the recording head.

FIG. 13 shows the fixing and positioning condition of the recording head 1 having the above-mentioned construction.

As seen from FIG. 13, the recording head 1 is biased toward the side support plate 212 by means of the spring member 256 of the head cover 250 and the spring member 223 of the carriage body 210, and is supported at three points by abutting against the pair of protrusions 221 and the protrusion 222. In this way, the recording head is fixed and positioned in a left-right direction, i.e., a direction perpendicular to a plane of FIG. 13 so that the recording head is not shifted in such direction and is not fallen.

Further, the recording head 1 is urged against the lower locking portion 219 by means of the protrusion 259 of the head cover 250, and thus, is fixed and positioned in an up-down direction. Further, the recording head 1 is fixed and positioned in a front-rear direction by the locking portions 220 of the carriage body 210 disposed between the protruded portion 132 of the recording head 1. In this case, since the recording head 1 is urged forwardly by the shifting movement of the connector slider 230 for connecting the connector portion 9 of the connector slider 230 (described later) to the connector 126 of the recording head, the protruded portion 132 of the recording head 1 is locked by the front locking portions 220, thus ensuring the fixation and positioning of the recording head in the front-rear direction.

Figure 14A:
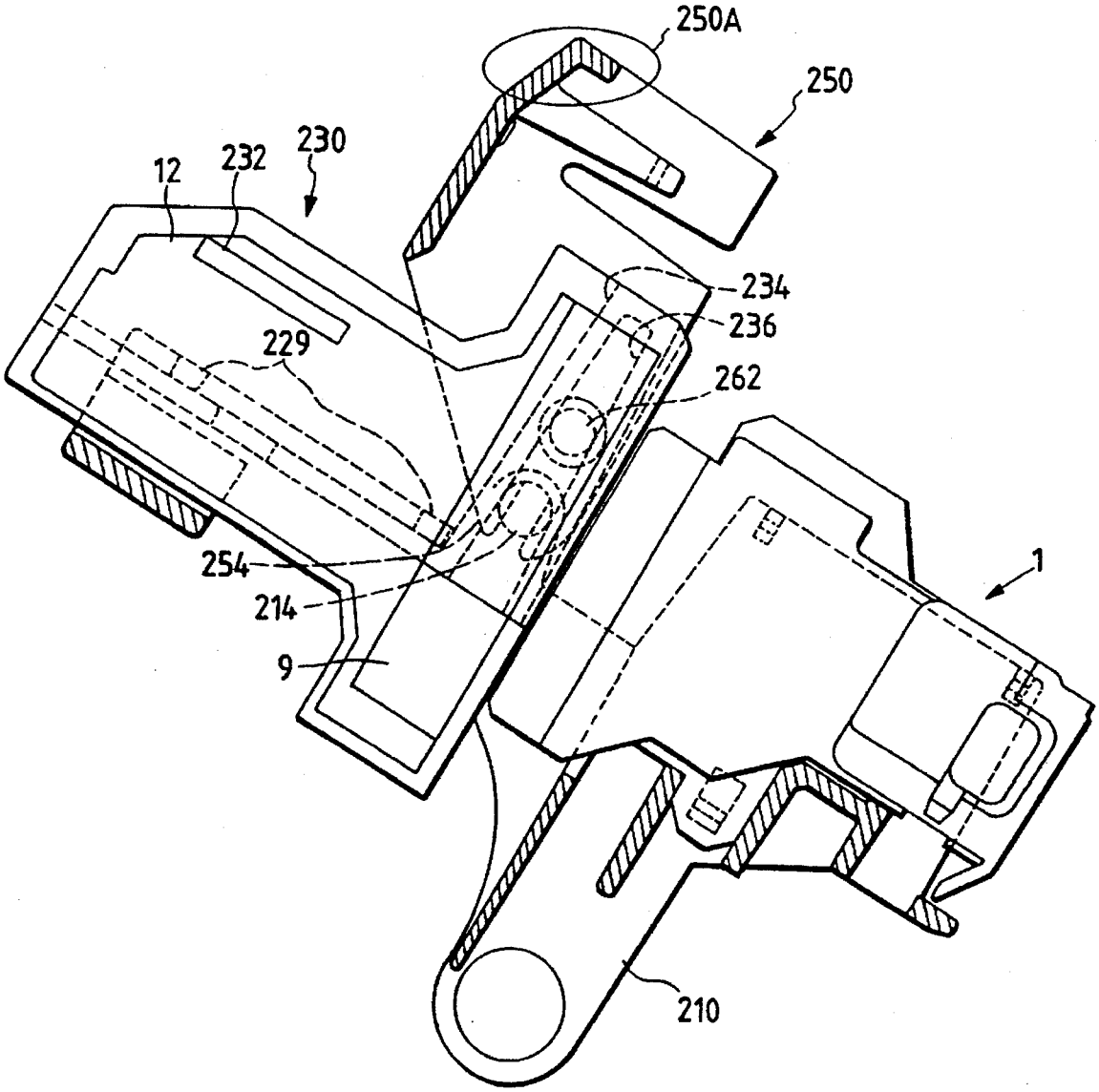
FIG. 14A is a side sectional view of the carriage with opening the head cover.
Figure 14B:
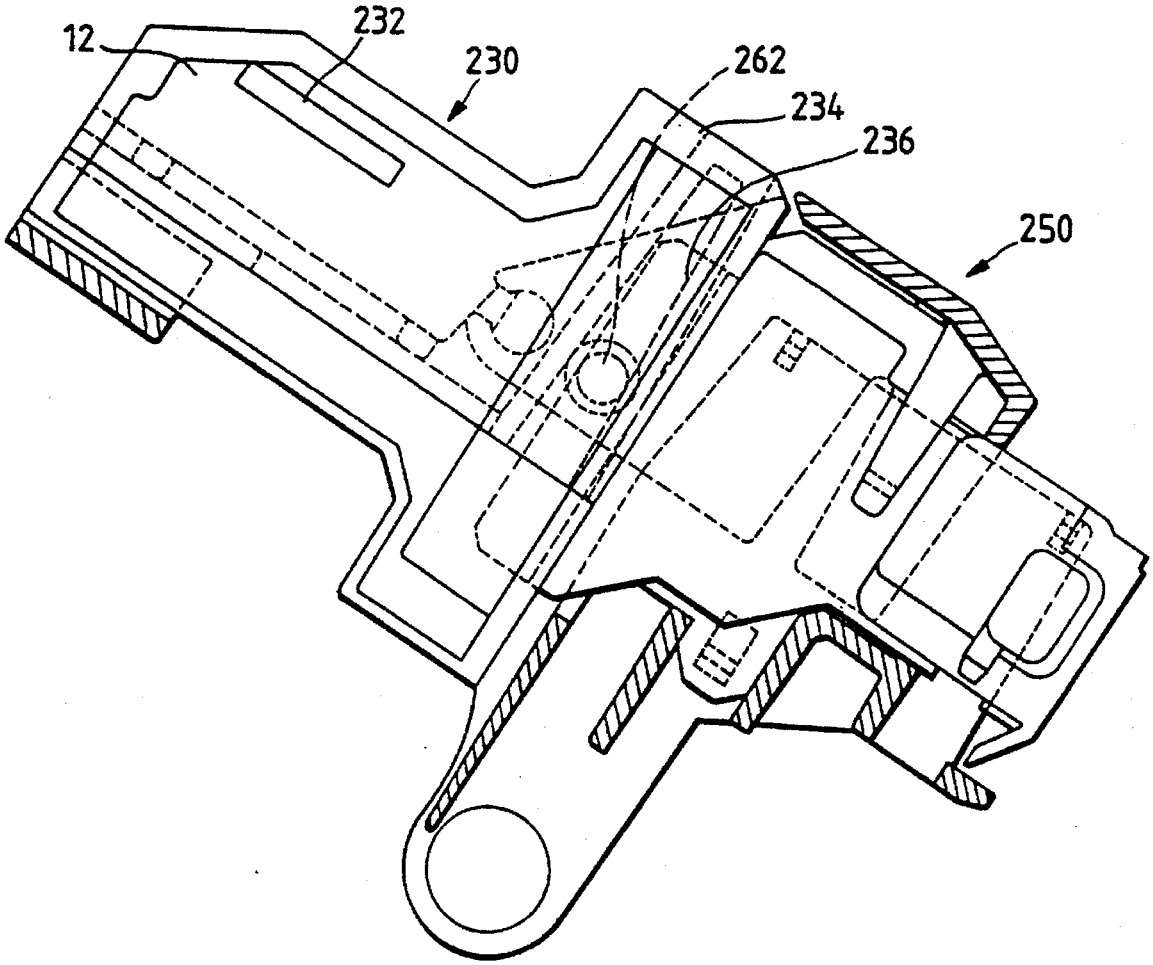
FIG. 14B is a side sectional view of the carriage with closing the head cover.
Figure 14C:
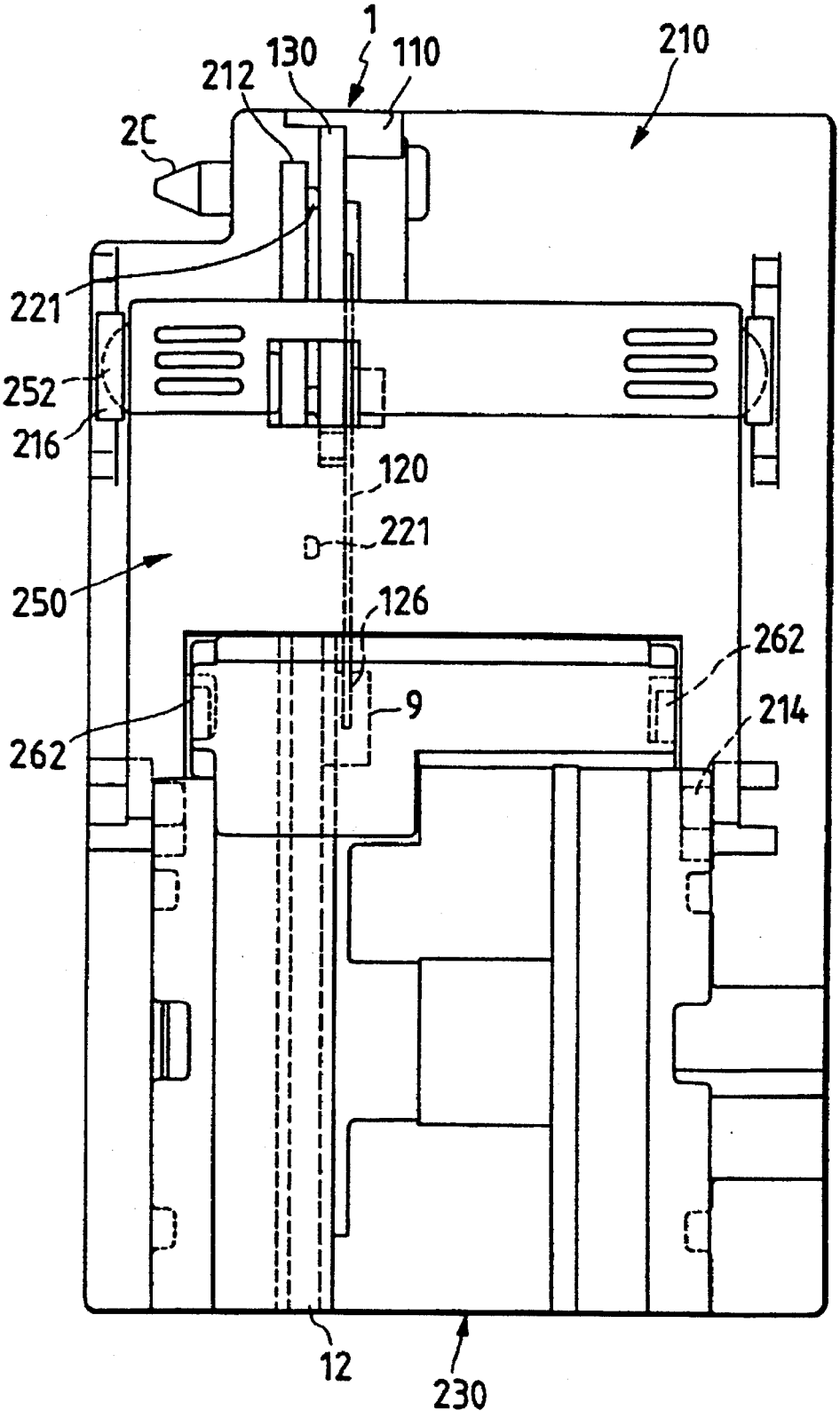
FIG. 14C is a plan view of the carriage with the head cover closed.

FIG. 14A is a side sectional view with opening the head cover 250, FIG. 14B is a side sectional view with closing the head cover, and FIG. 14C is a plan view with closing the head cover.

Now, the reference numeral 9 denotes the connector connectable to the connector 126 of the recording head 1; and 232 denotes a connector which is connected to the flexible cable for electrical connection to the control portion of the recording system. The reference numeral 234 denotes a ridged portion having a cam portion 236 for engaging by a connector slider shifting protrusion 262.

First of all, the recording head 1 is attached as mentioned above, with a condition that the head cover is opened, and the connection and communication of the ink supply system are performed. Before or after such operation, as shown in FIG. 14A, the connector slider shifting protrusion 262 of the head cover 250 is engaged by the cam portion 236 of the ridged portion 234 of the connector slider, and the pin receiving portions 254 are engaged by the pins 214 of the carriage body 210. In this condition, the head cover 250 can be rotated around the pins 214, and the protrusion 262 can be slid in the cam portion 236 relative thereto while maintaining the engagement between the protrusion 262 and the cam portion 236. Incidentally, in this condition, the connector slider 230 is in a retracted position with respect to the recording head 1, and thus, the connector 9 is not engaged by the connector 126.

When the head cover 250 is rotated in a clockwise direction (FIG. 14A) from the position shown in FIG. 14A, since the protrusion 262 is also rotated around the pins 214, the connector slider 230 is shifted toward the recording head 1 through the movement of the protrusion 262 and cam portion 236. When the head cover 250 is completely closed and the protrusion 252 of the head cover 250 is engaged by the cover locking member 216 of the carriage body 210 as shown in FIGS. 14B and 14C, the connector 9 of the connector slider 230 is engaged by the connector 126 of the recording head 1, thus establishing the electrical connection therebetween. Further, in this condition, the recording head 1 is fixed as mentioned above.

With the arrangement as mentioned above, the connectors can easily be electrical connected in response to the mere movement of the head cover 250 (acting as the protection cover of for the recording head 1) from the open condition to the closed condition. Inversely, when the head cover 250 is opened, since the connectors are separated from each other, the recording head 1 can easily be dismounted. Further, regarding an operating portion 250A used for rotating the head cover 250, since a distance between the rotation center (pins 214) and the engagement portion of the protrusion 262 and the cam portion 236 is shorter than a distance between the rotation center and the operating portion 250A, an operator can rotate the head cover 250 with a smaller force, while the connector 9 can be connected to and disconnected from the connector 126 with a greater force, thus positively performing the connection and disconnection of the connectors.

Further, since the recording head 1 can be fixed or released in response to the operation of the head cover 250, the fixation and positioning of the recording head 1 can very easily be effected, and the dismounting of the recording head is also simplified. Further, in the condition that the head cover 250 is closed, as shown in FIG. 14C, since the wiring substrate 120 of the recording head 1 is closed by the head cover 250, the inadvertent access to the substrate is prevented (only when the electrical connection of the wiring substrate is interrupted, the access to the substrate is possible), thus protecting the recording head 1 from being damage.

In addition, when the recording head is so designed that it is inserted from above for electrical connection in consideration of the operability of the recording head such as the mounting and dismounting of the head, the connector portion is conveniently disposed on the bottom surface of the head. However, if the ink is escaped from the connecting portion in the ink supply system, in order to protect the connector from the leaked ink, it is desirable that the connector is not disposed on the bottom side of the carriage. According to the illustrated embodiment, it is possible to protect the connector from the leaked ink without fail, without sacrificing the operability (mounting and dismounting) of the recording head 1.

Description will now be made of the construction of the ink cartridge 27 according to the present embodiment and the construction of the mounting portion of the body side on which the ink cartridge is mounted.

Figure 15A:
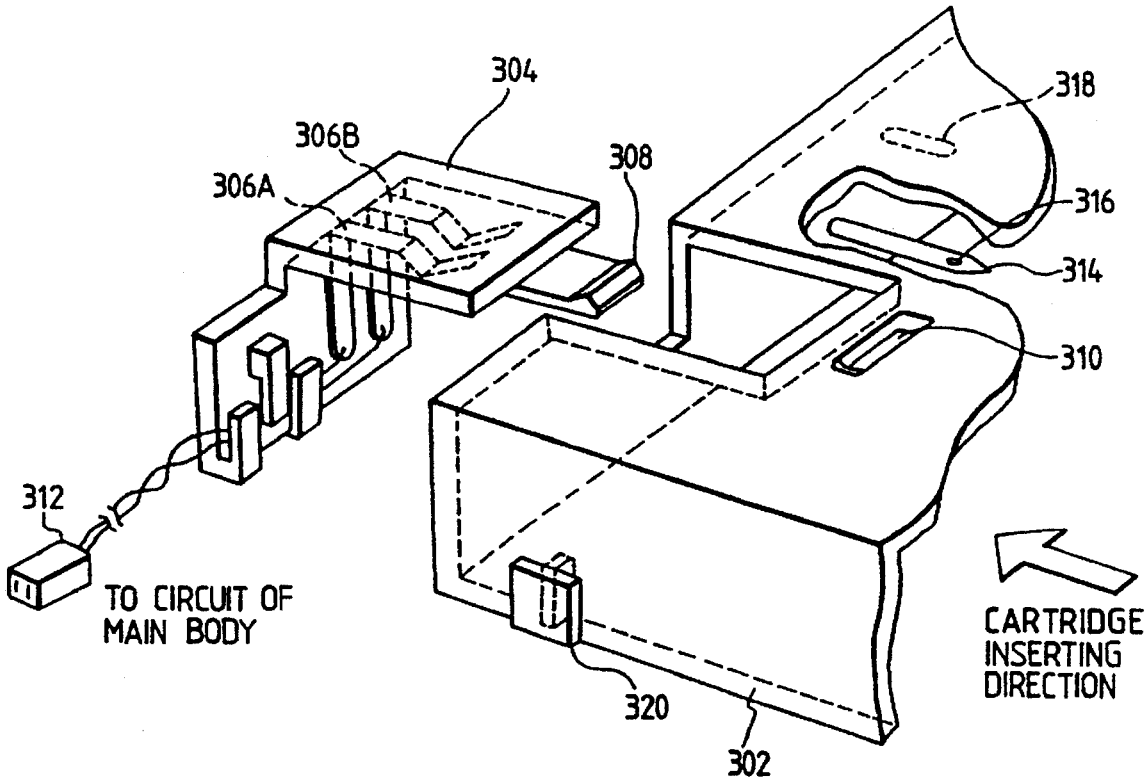
FIGS. 15A and 15B are a perspective view and a partial sectional view of an ink cartridge mounting portion of the recording system according to the present invention, respectively.
Figure 15B:
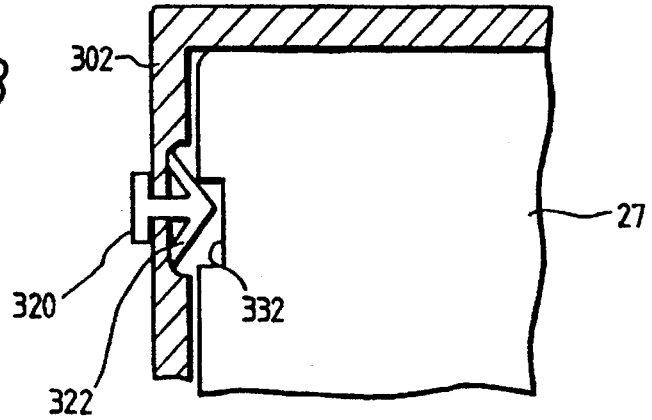

FIGS. 15A and 15B show an example of the construction of the mounting portion of the body side.

First, in FIG. 15A the reference numeral 302 designates a cartridge inserting portion for receiving the insertion of the ink cartridge 27. The reference numeral 304 denotes a contact holder for holding leaf spring-like contacts 306A and 306B as means for reading the information provided on the ink cartridge 27. The contact holder 304 is combined with the inserting portion 302 by a latch portion 308 being engaged with a hole 310 in the inserting portion 302. The reference numeral 312 designates a connector for connecting the contacts 306A and 306B to a body control unit.

The reference numeral 314 denotes a hollow needle member which enters the interior of a containing bag for ink to be supplied which is contained in the ink cartridge 27. The hollow needle member 314 is formed with an ink conducting aperture 316 in the tip end portion thereof. An ink supply tube is mounted on the other end of the needle 314, and the tube is connected to a common liquid chamber portion in a head chip 110 provided on the recording head 201. Means for detecting the amount of remaining ink can be provided intermediately of this ink supply system.

The reference numeral 318 denotes a waste ink pipe for directing waste ink to an ink absorbing member which enters the ink cartridge 27 and is contained therein. The waste ink is ink discharged during the ink refreshing process, for example, in the ink supply system or the common liquid chamber, or ink discharged during the recovery process.

The reference numeral 320 designates clicks as a fastening means for the ink cartridge 27. One click 320 is provided on each side of the inserting portion 302. These clicks 320, as shown in FIG. 15B, receive the insertion of the cartridge 27 by an engagement portion 322 being resiliently flexed with the engagement thereof with a side of the cartridge 27 during the insertion of the cartridge 27, and hold the cartridge 27 in that position by the engagement portion 322 restoring its original shape when a recess 332 in the cartridge 27 reaches the clicks.

Figure 16:
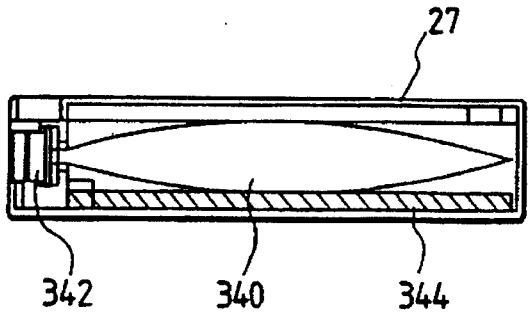
FIG. 16 is a sectional view of an ink cartridge according to an embodiment.

FIG. 16 shows an example of the construction of the ink cartridge 27 according to the present embodiment.

In FIG. 16, the reference numeral 340 denotes an ink bag containing therein ink to be supplied. The ink bag 340 is provided with a plug 342 made, for example, of rubber. The needle 314 is inserted into this plug 342 and further enters the interior of the ink bag, whereby ink communication is accomplished. The reference numeral 344 designates an ink absorbing member for receiving the above mentioned waste ink.

Figure 17:
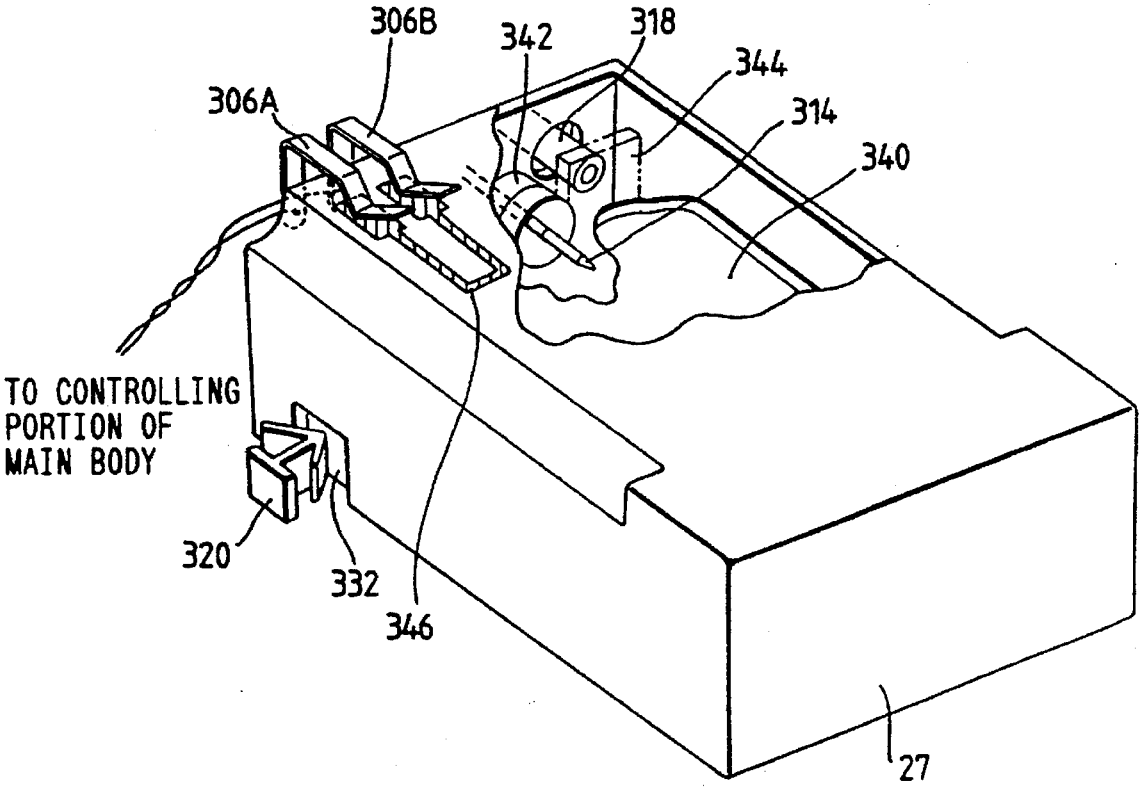
FIG. 17 is a perspective view explaining elements for interconnecting the cartridge and a body of the recording system.

FIG. 17 illustrates each portion for coupling the ink cartridge 27 to the body side. In FIG. 17, the reference numeral 346 denotes a wiring resistance pattern provided on the upper surface of the ink cartridge 27, and the control unit of the apparatus body can detect the presence or absence of the mounted ink cartridge in conformity with the conduction/nonconduction between the contacts 306A–306B through the wiring resistance pattern 346. Also, by this wiring resistance pattern being made into a resistance pattern having a resistance value determined in conformity with the color or density or the like of the ink containing this pattern, the control unit of the apparatus body can read the information thereof.

In the present embodiment, the location and dimensions of each coupling portion are determined so that an inserted position ① in which the needle 314 penetrates through the plug 342 with the insertion of the ink cartridge 27 and the aperture 316 comes to the interior of the ink bag 340, whereby ink communication is accomplished, a position ② in which the contacts 306A and 306B are connected to the wiring resistance pattern 346 and a position ③ in which the clicks 320 are engaged with recesses 332, whereby the ink cartridge 27 is held may lie in the named order in the direction of insertion. That is, design is made such that when the operation inserts the cartridge 27 the needle 314 first enters the interior of the ink bag 340 and when the cartridge is further inserted, the contacts 306A and 306B are then connected to the resistance pattern 346 and only when the cartridge is still further inserted, the clicks 320 come into engagement with the recesses 332. In the case of the present embodiment, the ink cartridge 27 contains the waste ink also therein and therefore, it is desirable that in the position ①, the waste ink pipe 318 be also positioned in the ink cartridge 27.

Figure 18:
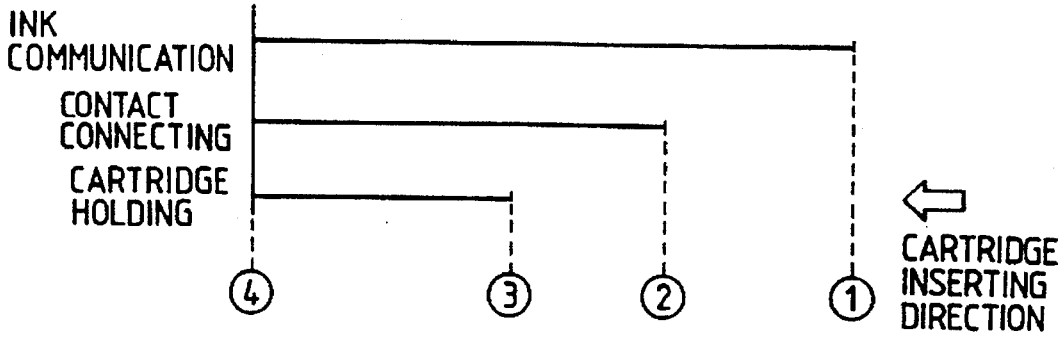
FIG. 18 is an explanatory view for explaining the relation of the connecting positions of the elements regarding the insertion of the cartridge in relation to the interconnection of FIG. 17.

The above-described positional relation is shown in FIG. 18. In FIG. 18, ④ indicates a position in which the ink cartridge 27 finally strikes in the direction of insertion, and the range from ③ to ④ is a range in which the cartridge 27 is movable in its held position due to the back-lash of the clicks 320 and recesses 332, or a range in which the clicks 320 come into engagement with the recesses 332 and the cartridge 27 is further inserted until it strikes against the innermost part of the inserting position 302.

If such positional relation is not assumed, there will occur inconveniences as shown in FIG. 19.

Figure 19A:
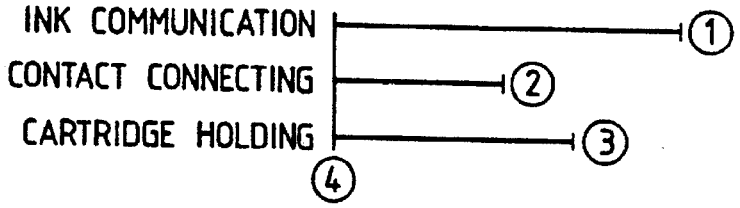
FIGS. 19A to 19E are explanatory views for explaining the inconvenience that arises when the above-mentioned relation of the connection positions is not attained.
Figure 19B:
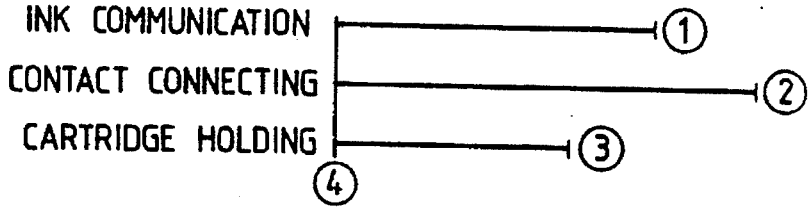
Figure 19C:
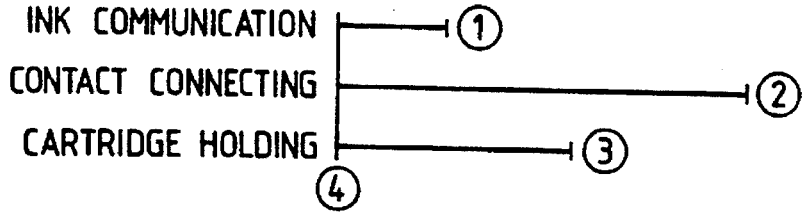

That is, in the relation shown in FIG. 19A, even if cartridge holding is done, the information regarding the cartridge cannot be read through the contacts 306A and 306B and therefore, in some cases, the control unit of the apparatus body may judge that the cartridge is not yet inserted. In the relation shown in FIG. 19B, contact connection is effected prior to ink communication and therefore, the control unit of the apparatus body may judge that the cartridge has been mounted, and may start a predetermined operation, whereby air may be introduced from the needle 314 into the ink supply system. This also holds true of the relation shown in FIG. 19C and moreover, if the operation discontinues the inserting operation by the confirmation of a click sound, ink communication will not be provided at all.

Figure 19D:
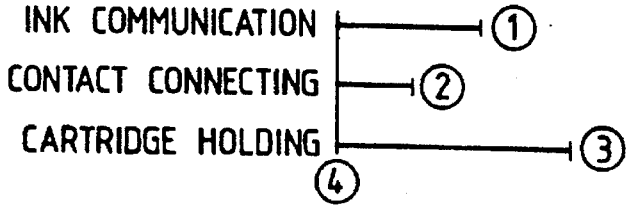
Figure 19E:
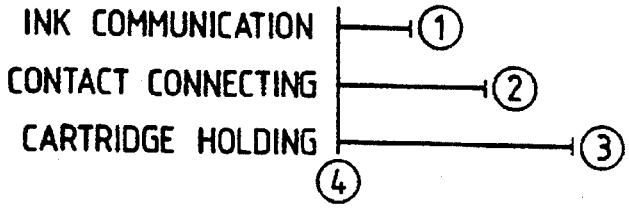

Also in the relations shown in FIGS. 19D and 19E, in spite of cartridge holding being done, there is a case where the needle 314 is out in that range or contact connection becomes unstable.

In contrast, according to the relation as shown in FIG. 18, ink communication, contact connection and cartridge holding take place in the named order during the insertion of the cartridge and therefore, the operator only need confirm cartridge holding simply by a click sound or the like. Also, even if the control unit of the apparatus body immediately starts its operation in response to contact connection, there will not occur the inconvenience that air is introduced into the ink supply system, and even if conversely, the cartridge 27 is pulled out during the operation of the control unit of the apparatus body, the control unit of the apparatus body will detect it before ink communication is cut off and therefore, a similar inconvenience will not occur if the operation is discontinued.

Figure 20A:
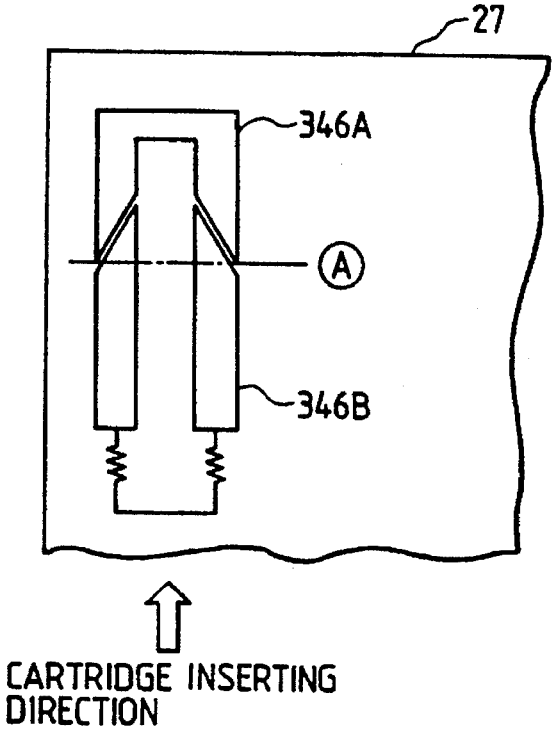
FIG. 20A is a partial enlarged view of an ink cartridge in an alternative form of that of FIGS. 17 and 18.

FIG. 20A shows a further improvement in the above-described construction. In the example shown there, the wiring resistance pattern is divided into two, and the pattern lying forwardly with respect to the direction of insertion of the cartridge is a pattern 346A for short-circuiting the contacts 306A–306B, and the pattern lying rearwardly is a resistance pattern 346B having a resistance value determined in conformity with the color, density, etc. of the ink.

Figure 20B:
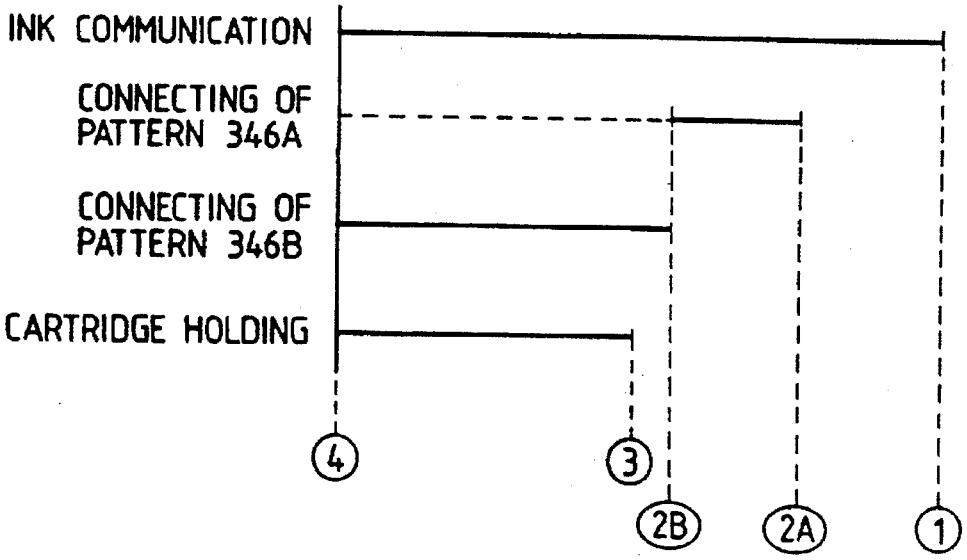
FIG. 20B is an explanatory view for explaining the relation of the connecting positions of the elements regarding the ink cartridge of FIG. 20A.

FIG. 20B shows the relation among a range within which ink communication is done in such a construction, a range within which the contacts 306A and 306B are in contact with the pattern 346A, a range within which the contacts 306A and 306B are in contact only with the pattern 346B, and a range within which the cartridge is held.

In FIG. 20B, ① indicates a limit position in which ink communication is done as described above, ③ indicates a limit position in which the cartridge 27 is held, and ④ indicates the innermost position in which the cartridge 27 strikes. Also, ②A indicates a limit position on this side with respect to the direction of insertion in which the contacts 306A and 306B are in contact with the pattern 346A and are short-circuited, and ②B indicates a limit position on this side with respect to the direction of insertion in which the contacts 306A and 306B are off the pattern 346A and in contact only with the pattern 346B and the resistance value of this pattern is read. Here, it is desirable that the position ②B be the position ③ or a position near it, and in the present example, a position near the position ③ in the direction of insertion of the cartridge in which particularly the engagement between the clicks 320 and the recesses 332 is released and the cartridge 27 is ready to slip out.

The relation among the various positions is as shown, and an effect similar to that in the case of FIG. 17 is obtained, but in the present embodiment, a more excellent effect is obtained by performing the following operation.

Figure 21A:
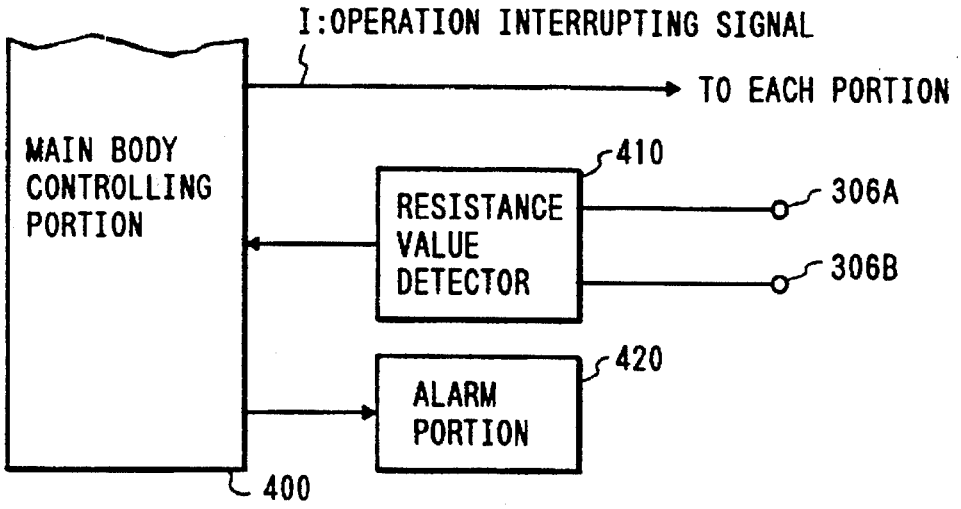
FIG. 21A is a block diagram of a control mechanism for the construction of FIGS. 20A and 20B.

FIG. 21A diagrammatically shows the essential portions of a control circuit according to the present embodiment. In FIG. 21A, the reference numeral 400 designates the control unit of the apparatus body which may be in the form of a microcomputer having a CPU for effecting the process of FIG. 21B and other control of the entire apparatus, an ROM storing therein a program or the like corresponding to the process procedure, and an RAM for working. The reference numeral 410 denotes a detector for detecting the resistance value between the contacts 306A and 306B. When said resistance value is "0", the detector 410 indicates that the contacts are short-circuited by the pattern 346A, and when said resistance value is infinity, it indicates that the ink cartridge 27 is not yet mounted, and when said resistance value is a predetermined value, it indicates that the ink cartridge 27 is properly held. The reference numeral 420 designates a display device for a message or the like, or output means of sound or the like, or a notice unit which may comprise a combination thereof. The letter I denotes an operation stopping signal for each portion.

Figure 21B:
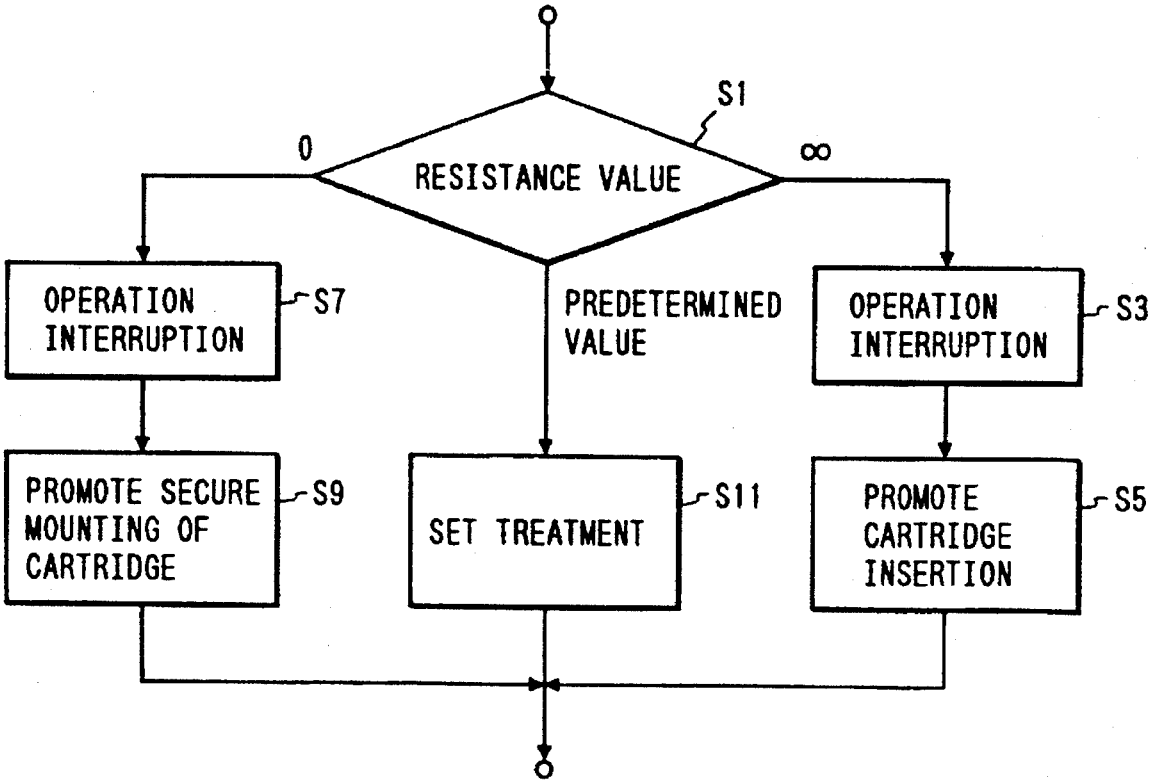
FIG. 21B is a flow chart for operating the control mechanism.

FIG. 21B shows an example of the operation procedure of the present embodiment and this procedure can be started at suitable timing during the closing of the power source switch of the apparatus or during the interchange of the ink cartridge 27, and in addition, during the recording operation.

When this procedure is started, the resistance value is first read at a step S1. If at this step, the resistance value is infinity, it means a case where the cartridge 27 is not mounted and therefore, advance is made to a step S3, where the operation of each portion is maintained in its stopped state, and at a step S5, the operator is noticed to promote to insert the cartridge 27.

On the other hand, if the resistance value is "0", it means that the cartridge 27 is ready to slip out and therefore, advance is made to a step S7, where the operation of each portion is stopped, whereafter at a step S9, the operator is noticed to promote the operation for the cartridge 27 to be surely held.

Further, if the resistance value is a predetermined value, it means that the cartridge 27 is already surely held and therefore, the information (the color or the like of the ink) regarding the cartridge corresponding to that resistance value is recognized and a setting process corresponding thereto is carried out (a step S11).

That is, when the operator has inserted the cartridge 27 but the clicks 320 have not come into the recesses 332, or when the engagement therebetween has been released for some reason or other, the cartridge holding is not complete and therefore the cartridge is liable to slip out. In such a case, the contacts 306A and 306B are connected to the pattern 346A, whereby the control unit 400 of the apparatus body becomes unable to read the inherent information of the cartridge 27 and therefore, the control unit 400 of the apparatus body can recognize such a situation and switch off the operation of the apparatus, thereby noticing the operator to promote to surely insert the cartridge 27. Thus, the operator can be noticed of such a danger that the cartridge 27 will slip out of the apparatus.

If the positional relation as described above can be basically kept with regard to the reading position for the information regarding the supplied ink communication and the cartridge and the cartridge holding position, it is of course possible that the cartridge and the inserting portion therefor adopt suitable constructions. For example, the cartridge holding need not always resort to the clicks and recesses. Further, the reading of the information regarding the ink cartridge need not always be electrical, but may be, for example, optical. Furthermore, in the above-described embodiment, the waste ink is also introduced into the cartridge, but the cartridge may also be of the type which effects ink supply alone.

Incidentally, the present invention provides the excellent advantages in the application to particularly the bubble jet recording head and bubble jet recording system among the ink jet recording systems, because the bubble jet type permits the high density recording and high fine recording.

Preferably, the typical construction and principle thereof can be realized by using the fundamental principles, for example, disclosed in U.S. Pat. Nos. 4,723,129 and 4,740,796. Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding the nucleate boiling to the electrical/thermal converters arranged in correspondence to the paper or liquid passages including the liquid (ink) therein, it is possible to form a bubble in the liquid (ink) in corresponding to the drive signal by generating the film boiling on the heat acting surface of the recording head due to the generation of the thermal energy in the electrical/thermal converters. Due to the growth and contraction of the bubble, the liquid (ink) is discharged from the discharge opening to form at least one ink droplet. When the drive signal has a pulse shape, since the growth and contraction of the bubble can be quickly effected, more excellent ink discharge are achieved. Such pulse-shaped drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid passages and electrical/thermal converters are combined (straight liquid passages or orthogonal liquid passages). In addition, the present invention can applicable to the construction wherein each discharge opening is constituted by a slit with which a plurality of electrical/thermal converters associated in common as disclosed in the Japanese Patent Laid-Open No. 59-123670 and the construction wherein openings for absorbing the pressure wave of the thermal energy are arranged in correspondence to the discharge openings as disclosed in the Japanese Patent Laid-Open No. 59-138461, because the recording can be correctly and effectively performed regardless of the configuration of the recording head.

Further, the present invention can be applied to a recording head of full-line type having a length corresponding to a maximum width of a recording medium to be recorded, as such recording head, the construction wherein such length is attained by combining a plurality of recording heads or a single recording head integrally formed may be adopted. In addition, among the above-mentioned serial types, the present invention is effectively applicable to a removable recording head of chip type wherein, when mounted on the recording system, electrical connection between it and the recording system and the supply of ink from the recording system can be permitted, or to a recording head of cartridge type wherein a cartridge is integrally formed with the head.

Further, it is preferable that a head recovering means and an auxiliary aiding means are added to the recording head according to the present invention, since the effect of the present invention is further improved. More concretely, these means include a capping means for capping the recording head, cleaning means, pressurizing or suction means, and an auxiliary heating means comprising electrical/thermal converters or other heating elements or the combination thereof. Further, it is effective for the stable recording to perform an auxiliary discharge mode wherein the ink discharge regardless of the recording ink discharge is effected.

Further, as to the kind and number of the recording head to be mounted, each recording head may correspond to each different color ink, or a plurality of recording heads can be used for a plurality of ink having different colors and/or different density.

Furthermore, the recording system according to the present invention may be in the form of an image output terminal device for an information processing apparatus such as a computer, or a copying machine combined with a reader, or a facsimile having the sending and receiving functions.

Incidentally, the present invention is not limited to the above-mentioned ink jet recording system, but may be applicable to a recording system used with a copying machine, by providing spurs in its sheet feeding mechanism.

Next, other embodiment of the present invention will be explained.

Figure 22:
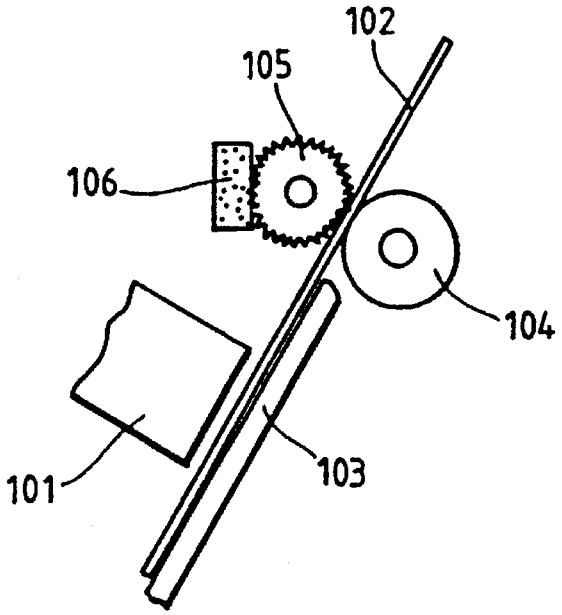
FIG. 22 is a schematic partial sectional view of a main portion of an ink jet recording system according to a further embodiment of the present invention.

FIG. 22 is a schematic sectional view of a main portion of an ink jet recording system according to a further embodiment of the present invention. In FIG. 22, the ink jet recording system is so designed that the recording is effected by discharging the recording liquid droplets from a recording head 101 onto a recording medium 102 such as a paper, plastic sheet and the like, and a platen 103 is disposed in confronting relation to the recording head 101. The recording medium 102 is contacted to the platen 103 and is fed while maintaining a distance of about 0.5~1.0 mm between the recording medium and the discharging surface of the recording head 101.

At a downstream side of the recording head 101 in the recording medium feeding direction, a pair of rollers 104, 105 are arranged for applying the feeding force to the recorded recording medium 102. The paired rollers 105, 104 are pressed against the front and back surfaces of the recording medium 102, respectively, and the roller 105 contacting the front surface (recorded surface) of the recording medium is constituted by a spur in the form of the toothed wheel.

On the toothed peripheral surface of the roller (spur) 105 which can contact the recorded surface of the recording medium, a water absorbing member 106 acting as a cleaning member is contacted. The water absorbing member 106 is made of porous sponge-like material and has a parallelepipedal shape which slidingly contacts the spur roller 105.

In this way, in the ink jet recording system according to the present invention, i.e., in the ink jet recording system wherein the recording is effected by discharging the recording liquid droplets from the recording head 101 onto the recording medium 102 and the recorded recording medium is fed by the paired rollers 104, 105 disposed at the downstream side of the recording head 101, the water absorbing member 106 contacts at least a portion (peripheral portion), contacting the recorded surface of the recording medium, of the roller 105 near the recorded surface (among the paired rollers 104, 105).

According to the illustrated embodiment, since the water absorbing member 106 contacts at least a portion, contacting the recorded surface of the recording medium, of the roller 105 near the recorded surface among the paired rollers 104, 105 for feeding the recorded recording medium, the water absorbing member 106 can absorb or remove the ink transferred from the recorded surface of the recording medium 102 onto the spur roller 105, and thus preventing the ink from being transferred onto the recording medium 102 again.

In this way, even if the ink on the recording medium 102 is not completely dried, it is possible to prevent the contamination of the recording medium 102 with the ink from the rollers 104, 105.

Figure 23:
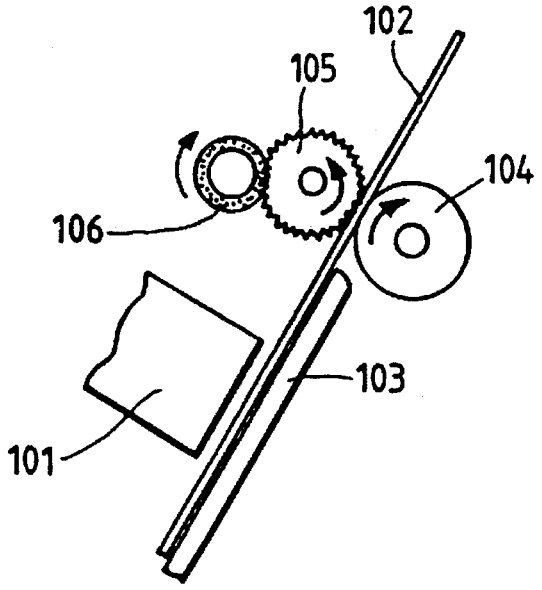
FIG. 23 is a schematic partial sectional view of a main portion of an ink jet recording system according to a still further embodiment of the present invention.

FIG. 23 is a sectional view of a main portion of an ink jet recording system according to a still further embodiment of the present invention.

In this embodiment, the water absorbing member 106 acting as the cleaning member has a roller shape outer peripheral surface of which is urged against the peripheral surface of the spur roller 105, whereby water absorbing member is driven by the rotation of the spur roller. Other constructions of the embodiment of FIG. 23 is the same as those of the embodiment of FIG. 22; thus, the same constructural elements as those in FIG. 22 are designated by the same reference numerals, and the detailed explanation thereof will be omitted.

According to the embodiment of FIG. 23, the same technical advantage as that of FIG. 22 can be obtained, and at the same time, since the water absorbing member 106 is constituted by the driven roller, the water absorbing member 106 always contacts the spur roller 105 at different portions thereof, whereby the water absorbing member has high absorbing ability even regarding the continuous ink contamination on the spur roller.

In FIG. 24 showing a sectional view of a main portion of an ink jet recording system according to the other embodiment of the present invention, the ink jet recording system is so designed that the recording is effected by discharging the recording liquid droplets from a recording head 101 onto a recording medium 102 such as a paper, plastic sheet and the like, and a platen 103 is disposed in confronting relation to the recording head 101. The recording medium 102 is contacted to the platen 103 and is fed while maintaining a distance of about 0.5~1.0 mm between the recording medium and the discharging surface of the recording head 101.

At a downstream side of the recording head 101 in the recording medium feeding direction, a pair of rollers 104, 105 are arranged for applying the feeding force to the recorded recording medium 102. The paired rollers 105, 104 are pressed against the front and back surfaces of the recording medium 102, respectively, and the roller 105 contacting the front surface (recorded surface) of the recording medium is constituted by a spur (first spur) in the form of the toothed wheel.

Further, between the recording head 101 and the first spur 105, a second rotatable spur 107 is disposed with a distance between this spur and the recording medium 102 substantially the same as the distance (for example, 0.5~1.0 mm) between the recording head 101 and the recording medium 102.

A roller 108 is rotatably (such as driven roller) supported; this roller 108 contacts both first and second spurs 105 and 107 and, at least a portion of this roller 108 contacting the spurs 105, 107 is constituted by a water absorbing member. The water absorbing member may be made of, for example, porous sponge-like material.

Figure 24A:
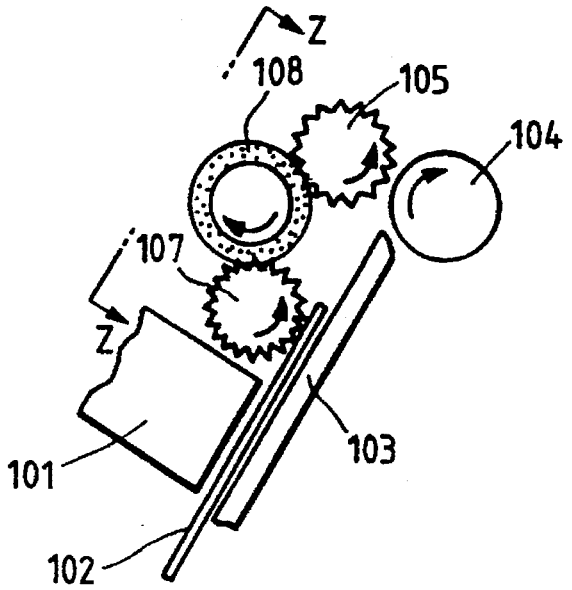
FIGS. 24A and 24B are schematic partial sectional views of a main portion of an ink jet recording system according to other embodiment of the present invention, where
Figure 24B:
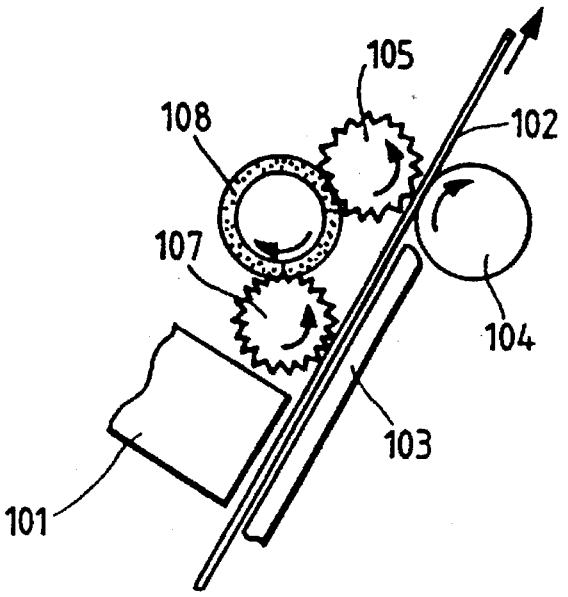

FIG. 24A shows a condition that a leading end of the recording medium 102 reaches the second spur 107 but does not reach the first spur 105, and FIG. 24B shows a condition that the recording medium 102 has reached the paired rollers 104, 105 and is being fed positively by the paired rollers 104, 105.

According to the embodiment shown in FIGS. 24A and 24B, since the second spur 107 is disposed between the recording head 101 and the feeding (ejecting) first spur 105, it is possible to eject the recording medium 102 while accurately guiding the recording medium. Further, since the water absorbing cleaning roller 108 is rotatably contacted to both the first and second spurs 105, 107, even if the ink is transferred from the recorded surface onto the guiding second spur 107, the ink can be removed from the toothed portion of the second spur by means of the roller 108, thus preventing the ink from being transferred from the second spur onto the recording medium again. In this way, it is possible to prevent the contamination of the recording medium 102 with the ink on the second spur 107.

Further, even if the ink on the recording medium 102 is transferred onto the first feeding spur 105, since the ink stuck to the peripheral toothed portion of the first spur 105 is removed by the water absorbing roller 108, the recording medium is not smeared with the ink (by transferring from the first spur onto the recording medium again).

The material constituting the outer surface of the roller 108 may be a sponge of urethane group having good water absorbing ability and driving force transmitting ability.

Figure 25:
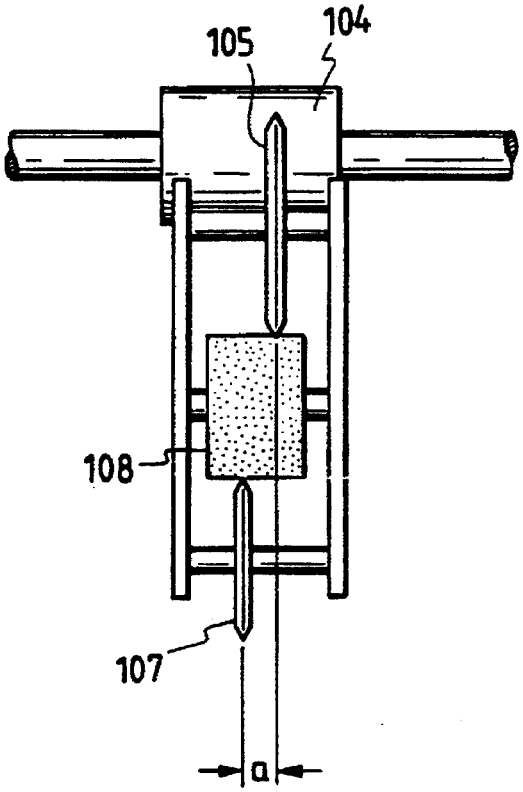
FIG. 25 is a schematic plan view showing the positions of first and second spurs of FIGS. 24A and 24B.

FIG. 25 is a plan view of the first and second spurs 105, 107 and the roller 108 looking at along the line Z—Z in FIG. 24A.

Although the first and second spurs 105, 107 can be arranged on a single straight line, as shown in FIG. 25, when these spurs are offset by a predetermined amount a, it is possible to disperse the ink absorbing areas on the roller 108, thus keeping the ink absorbing ability of the roller 108 for a long time.

Incidentally, with the arrangement of FIG. 24, generally, while the ejector roller 104 is used as a driving roller, in carrying out the present invention, the first spur 105 may be used as a driving roller and the ejector roller 105 may be used as a driven roller. Further, the second guiding spur 107 may be used as a driving roller and the first spur 105 and the ejector roller 104 may be driven by the rotation of the second spur 107.

Figure 26:
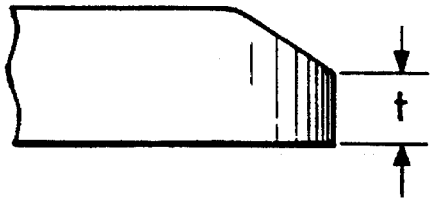
FIGS. 26 and 27 are respectively cross section and plan view of the tooth.
Figure 27:
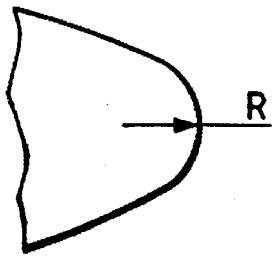

In FIGS. 26 and 27, cross section and plan view are shown in enlarged scale. At its tip, each spur may have a radius of curvature, R, and a thickness, t.

We claim:

1. A recording apparatus comprising:

recording means for performing recording on a sheet;

a first rotary member disposed downstream of said recording means in the sheet feeding direction and provided with a plurality of teeth at an outer periphery thereof to be contacted with a recorded surface of the sheet;

a second rotary member disposed downstream of said first rotary member in the sheet feeding direction and provided with a plurality of teeth at an outer periphery thereof to be contacted with a recorded surface of the sheet;

a third rotary member, disposed adjacent said first rotary member and at substantially the same downstream position that said first rotary member is disposed, for contacting a part of the sheet adjacent the part of the sheet contacted by said plurality of teeth of said first rotary member, wherein said teeth of said first rotary member are offset from said teeth of said second rotary member in a direction perpendicular to the sheet feeding direction; and cleaning means, wherein said cleaning means includes a cleaning member for contacting said teeth of said first and second rotary members.

2. A sheet conveying apparatus, comprising:

a first rotary member having a plurality of teeth;

a second rotary member having a plurality of teeth and being disposed downstream of said first rotary member in a sheet conveying direction; and a single cleaning member simultaneously contacted with said first rotary member and said second rotary member for cleaning said plurality of teeth of said first rotary member and said plurality of teeth of said second rotary member.

3. A sheet conveying apparatus according to claim 2, wherein said cleaning member rotates while engaging said second rotary member.

4. A sheet conveying apparatus according to claim 2, wherein said plurality of teeth of said first rotary member are arranged on an outer peripheral surface of said first rotary member in a row, and said plurality of teeth of said second rotary member are arranged on an outer peripheral surface of said second rotary member in a row, and wherein said row of teeth of said first rotary member and said row of teeth of said second rotary member are offset from each other in a direction orthogonal to the sheet conveying direction.

5. A sheet conveying apparatus according to claim 4, wherein said teeth of said first rotary member and the teeth of said second rotary member are so constructed as to penetrate into said cleaning member.

6. A sheet conveying apparatus according to claim 5, wherein said cleaning member is so constructed as to rotate while engaging said first and second rotary members.

7. A sheet conveying apparatus according to claim 6, further comprising a shaft member for pivotably supporting said cleaning member, a cover member for supporting said shaft member and for covering a main body of said sheet conveying apparatus, and positioning means for positioning said shaft member by engaging said shaft member when said cover member is closed.

8. A sheet conveying apparatus according to claim 2, wherein the teeth of said second rotary member contact the sheet at one of a point and a line.

9. A sheet conveying apparatus according to claim 2, wherein said plurality of teeth of said second rotary member include plural rows of teeth arranged along an outer peripheral surface of said second rotary member.

10. A sheet conveying apparatus according to claim 2, wherein said cleaning member comprises an ink absorbing material and said cleaning member is wider than said second rotary member.

11. A recording apparatus, comprising:

a first rotary member having a plurality of teeth;

a second rotary member having a plurality of teeth and being disposed downstream of said first rotary member in a sheet conveying direction;

a single cleaning member simultaneously contacted with said first rotary member and said second rotary member for cleaning said plurality of teeth of said first rotary member and said plurality of teeth of said second rotary member; and recording means for recording an image on a conveyed sheet.

12. A recording apparatus according to claim 11, wherein said cleaning member comprises an ink absorbing material and said cleaning member is wider than said second rotary member.

13. An ink jet recording apparatus, comprising:

a first rotary member having a plurality of teeth;

a second rotary member having a plurality of teeth and being disposed downstream of said first rotary member in a sheet conveying direction;

a single cleaning member simultaneously contacted with said first rotary member and said second rotary member for cleaning said plurality of teeth of said first rotary member and said plurality of teeth of said second rotary member; and a recording area for performing a recording by a recording means provided thereat.

14. An ink jet recording apparatus according to claim 13, wherein said cleaning means rotates while engaging said second rotary member.

15. An ink jet recording apparatus according to claim 13, wherein said plurality of teeth of said first rotary member are arranged on an outer peripheral surface of said first rotary member in a row, and said plurality of teeth of said second rotary member are arranged on an outer peripheral surface of said second rotary member in a row, and wherein said row of teeth of said first rotary member and said row of teeth of said second rotary member are offset from each other in a direction orthogonal to the sheet conveying direction.

16. An ink jet recording apparatus according to claim 13, wherein said cleaning member is so constructed as to rotate while engaging said first and second rotary members.

17. An ink jet recording apparatus according to claim 13, wherein the teeth of said second rotary member contact the sheet at one of a point and a line.

18. An ink jet recording apparatus according to claim 13, wherein the plurality of teeth of said second rotary member include plural rows of teeth arranged along an outer peripheral surface of said second rotary member.

19. A recording apparatus, comprising:

a first rotary member having a plurality of teeth;

a second rotary member having a plurality of teeth and being disposed downstream of said first rotary member in a sheet conveying direction;

a single cleaning member simultaneously contacted with said first rotary member and said second rotary member for cleaning said plurality of teeth of said first rotary member and said plurality of teeth of said second rotary member; and a recording area for performing a recording by a recording means provided thereat.

20. A recording apparatus according to claim 19, wherein said cleaning member comprises an ink absorbing material and said cleaning member is wider than said second rotary member.

21. A conveying unit removably mounted onto a shaft supporting a first rotary member having a plurality of teeth and provided in a convey apparatus, said conveying unit comprising:

a second rotary member comprising a plurality of teeth; and a cleaning member, wherein when said conveying unit is mounted onto the shaft, said cleaning member cleans both of the first rotary member supported by the shaft in the convey apparatus and said second rotary member in said conveying unit.

22. A conveying unit according to claim 21, wherein said convey apparatus has, downstream of an ink jet recording area, a mounting area for mounting the shaft and said conveying unit.

23. A conveying unit according to claim 21, wherein said cleaning member comprises an absorbing material and said cleaning member is wider than said second rotary member in said conveying unit.

24. A sheet conveying apparatus, comprising:

a first rotary member having a plurality of teeth therearound;

a second rotary member having a plurality of teeth therearound and being disposed downstream of said first rotary member in a sheet conveying direction; and a single rotatable cleaning member disposed to be simultaneously contacted with said first rotary member and said second rotary member for cleaning said plurality of teeth thereof upon rotation, said cleaning member being held in a holder by engaging a shaft thereof with a recess formed on the holder in a normal direction and in a direction making a predetermined angle relative to a line connecting the first and second rotary members, so that the shaft of said cleaning member engages with the recess of said holder by gravity to prevent disengagement of the shaft from the recess.

* * * * *

UNITED STATES PATENT AND TRADEMARK OFFICE

CERTIFICATE OF CORRECTION

PATENT NO. : 5,636,929

DATED : June 10, 1997

INVENTOR(S) : Asano et al.

It is certified that error appears in the above-indentified patent and that said Letters Patent is hereby corrected as shown below: On the title page;

[56] References Cited:

FOREIGN PATENT DOCUMENTS insert:
"01-226379 9/1989 Japan
01-267077 10/1989 Japan--.

COLUMN 3:

Line 67, "with emitting" should read --omitting--.

COLUMN 4:

Line 61, "an" should read --a--.

COLUMN 13:

Line 3, "damage." should read --damaged.--.

Signed and Sealed this

Thirteenth Day of January, 1998

Bruce Lehman

*Attest:*

BRUCE LEHMAN

*Attesting Officer*

*Commissioner of Patents and Trademarks*